US010839823B2

(12) United States Patent
Nakadai et al.

(10) Patent No.: US 10,839,823 B2
(45) Date of Patent: Nov. 17, 2020

(54) SOUND SOURCE SEPARATING DEVICE, SOUND SOURCE SEPARATING METHOD, AND PROGRAM

(71) Applicant: HONDA MOTOR CO., LTD., Tokyo (JP)

(72) Inventors: Kazuhiro Nakadai, Sakura (JP); Yuta Kusaka, Tokyo (JP); Katsutoshi Itoyama, Wako (JP); Kenji Nishida, Tsukuba (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/790,278

(22) Filed: Feb. 13, 2020

(65) Prior Publication Data

US 2020/0273480 A1 Aug. 27, 2020

(30) Foreign Application Priority Data

Feb. 27, 2019 (JP) ..... 2019-034713

(51) Int. Cl.
*G10L 21/0308* (2013.01)
*G10L 25/51* (2013.01)
(Continued)

(52) U.S. Cl.
CPC ..... *G10L 21/0308* (2013.01); *G10L 21/028* (2013.01); *G10L 25/18* (2013.01); *G10L 25/51* (2013.01)

(58) Field of Classification Search
CPC ..... G10L 21/028; G10L 21/0208; G10L 21/0272; G10L 21/0308; G10L 25/18; G10L 25/51
(Continued)

(56) References Cited

U.S. PATENT DOCUMENTS 7,809,146 B2 * 10/2010 Hiroe ..... G10L 21/0272 381/94.3
8,015,003 B2 * 9/2011 Wilson ..... G10L 21/0208 704/226
(Continued)

FOREIGN PATENT DOCUMENTS

JP 2013-033196 2/2013

OTHER PUBLICATIONS

Dawen Liang et al., Beta Process Non-negative Matrix Factorization with Stochastic Structured Mean-Field Variational Inference, arXiv, vol. 1411.1804, 2014, English text, 6 pages.

*Primary Examiner* — Xu Mei
(74) *Attorney, Agent, or Firm* — Rankin, Hill & Clark LLP

(57) ABSTRACT

A sound source separating device includes: a signal acquiring unit that acquires the sound signal including mixed sounds from a plurality of sound sources; a start information acquiring unit that acquires start information representing a start timing of at least one sound source among the plurality of sound sources; and a sound source separating unit that separates a specific sound source from the sound signal by setting a binary mask controlling presence of the sound source using a variable of "0" and "1" and using a Markov chain for the activation on the basis of the start information and decomposing the spectrogram generated from the sound signal into the base spectrum and the activation through non-negative matrix factorization using the set binary mask S.

6 Claims, 20 Drawing Sheets

(51) Int. Cl.
*G10L 25/18* (2013.01)
*G10L 21/028* (2013.01)

(58) Field of Classification Search
USPC ..... 381/94.1, 92, 66, 56; 704/226, 227, 228; 702/190, 191
See application file for complete search history.

(56) References Cited

U.S. PATENT DOCUMENTS

| | | | | |
|---|---|---|---|---|
| 9,093,056 | B2 * | 7/2015 | Pardo | H04S 7/40 |
| 9,460,732 | B2 * | 10/2016 | Wingate | G10L 21/0272 |
| 9,704,505 | B2 * | 7/2017 | Tawada | G10L 21/0208 |
| 9,966,088 | B2 * | 5/2018 | Mysore | G10L 21/028 |
| 10,657,973 | B2 * | 5/2020 | Guo | G10L 19/008 |
| 2010/0138010 | A1 * | 6/2010 | Aziz Sbai | G10H 1/0008 700/94 |
| 2012/0045066 | A1 * | 2/2012 | Nakadai | G10L 21/028 381/20 |
| 2016/0064000 | A1 * | 3/2016 | Mizumoto | G06K 9/4647 704/233 |
| 2016/0372129 | A1 * | 12/2016 | Nakadai | G10L 25/84 |
| 2018/0070170 | A1 * | 3/2018 | Nakadai | H04R 3/005 |
| 2018/0240470 | A1 * | 8/2018 | Wang | G10L 19/008 |

* cited by examiner

SOUND SOURCE SEPARATING DEVICE, SOUND SOURCE SEPARATING METHOD, AND PROGRAM

CROSS-REFERENCE TO RELATED APPLICATION

Priority is claimed on Japanese Patent Application No. 2019-034713, filed Feb. 27, 2019, the content of which is incorporated herein by reference.

BACKGROUND OF THE INVENTION

Field of the Invention

The present invention relates to a sound source separating device, a sound source separating method, and a program.

Description of Related Art

As illustrated in FIG. 24, as a technique for separating a sound source included in a monaural sound signal g903 recorded by one microphone g902, non-negative matrix factorization (NMF) has been researched. FIG. 24 is a diagram illustrating an example of a sound signal recorded by one microphone. In the example illustrated in FIG. 24, sound signals from three types of musical instruments g901 are mixed in the recorded sound signal.

According to the technique of this NMF, as illustrated in FIG. 25, spectrograms g912 and g913 are generated from an input sound signal g911, and the generated spectrograms are decomposed into a base spectrum g914 (tone pattern) and an activation g915 (a magnitude and a timing of the base spectrum), whereby sound sources (for example, types of musical instruments making the sounds) in the sound signal are separated. FIG. 25 is a diagram illustrating schematic NMF.

In the area of the base spectrum g914, the horizontal axis represents amplitude, and the vertical axis represents frequency. In the area of the activation g915, the horizontal axis represents time, and the vertical axis represents amplitude. Here, the base spectrum represents a spectrum pattern of the tone of each musical instrument included in an amplitude spectrum of a mixed sound. In addition, the activation represents changes in the amplitude of the base spectrum with respect to time, i.e., appearance timings and magnitudes of the tone of each musical instrument. In the NMF, as illustrated in FIG. 25, an amplitude spectrum X is approximated as a product of the base spectrum W and activation H.

As a sound source separating technique using NMF, penalty conditional supervised NMF has been proposed (for example, see Japanese Unexamined Patent Application, First Publication No. 2013-33196 (hereinafter, Patent Document 1)). In the technology described in Patent Document 1, a storage device stores a non-negative base matrix F including K base vectors representing an amplitude spectrum of each component of a sound of a first sound source.

In addition, in the technology described in Patent Document 1, a matrix decomposing unit generates a coefficient matrix G including K coefficient vectors representing changes in the weighting value with respect to time for each base vector of a base matrix F, a base matrix h including D base vectors representing an amplitude spectrum of each component of a sound of a second sound source, and a coefficient matrix U including D coefficient vectors representing changes in the weighting value with respect to time for each base vector of the base matrix h through non-negative matrix factorization using the base matrix F from an observation matrix Y representing an amplitude spectrogram of a sound signal SA(t) representing a mixed sound where the sound of the first sound source and the sound of the second sound source are mixed, and a sound generating unit generates at least one of a sound signal SB(t) according to the base matrix F and the coefficient matrix G and a sound signal SB(t) according to the base matrix h and the coefficient matrix U.

SUMMARY OF THE INVENTION

In the supervised NMF described in Patent Document 1, although a target sound source can be separated using a teacher sound, there is a problem in that separation accuracy decreases when there is a difference between the tone of a sound source desired to be separated and the tone of a teacher sound.

An aspect of the present invention has been made in view of the problem described above, and an object thereof is to provide a sound source separating device, a sound source separating method, and a program capable of separating a sound source from a monaural sound source in which sounds of a plurality of sound sources are mixed with higher accuracy than by using conventional methods.

In order to solve the problem described above, the present invention employs the following aspects.

(1) A sound source separating device according to one aspect of the present invention is a sound source separating device separating a specific sound source from a sound signal by decomposing a spectrogram generated from the sound signal into a base spectrum and an activation through non-negative matrix factorization and includes: a signal acquiring unit configured to acquire the sound signal including mixed sounds from a plurality of sound sources; a start information acquiring unit configured to acquire start information representing a start timing of at least one sound source among the plurality of sound sources; and a sound source separating unit configured to separate a specific sound source from the sound signal by setting a binary mask S controlling presence of the sound source using a variable of "0" and "1" and using a Markov chain for the activation H on the basis of the start information and decomposing the spectrogram X generated from the sound signal into the base spectrum W and the activation H through non-negative matrix factorization using the set binary mask S.

(2) In the aspect (1) described above, the sound source separating unit may indirectly use an onset I based on the start information to assist estimation of the binary mask S in Gibbs sampling in which the base spectrum W, the activation H, and the binary mask S are estimated without including the start information in a probability model of the non-negative matrix factorization.

(3) In the aspect (1) or (2) described above, the sound source separating unit may estimate the base spectrum W, the activation H, and the binary mask S by estimating an expected value of each of the base spectrum W, the activation H, and the binary mask S using Gibbs sampling.

(4) In any one of the aspects (1) to (3) described above, the sound source separating unit may initialize the base spectrum W, the activation H, and the binary mask S and thereafter estimate an expected value for each of the base spectrum W, the activation H, and the binary mask S using the following equations using Gibbs sampling.

$$W^{(i+1)} \sim p(W|Z^{(i+1)}, H^{(i)}, S^{(i)}, X)$$

$$H^{(i+1)} \sim p(H|Z^{(i+1)}, W^{(i+1)}, S^{(i)}, X)$$

$$S^{(i+1)} \sim p(S|Z^{(i+1)}, W^{(i+1)}, H^{(i+1)}, X)$$

(5) A sound source separating method according to one aspect of the present invention is a sound source separating method in a sound source separating device separating a specific sound source from a sound signal by decomposing a spectrogram generated from the sound signal into a base spectrum and an activation through non-negative matrix factorization and includes: acquiring the sound signal including mixed sounds from a plurality of sound sources by using a signal acquiring unit; acquiring start information representing a start timing of at least one sound source among the plurality of sound sources by using a start information acquiring unit; and separating a specific sound source from the sound signal by setting a binary mask S controlling presence of the sound source using a variable of "0" and "1" and using a Markov chain for the activation H on the basis of the start information and decomposing the spectrogram X generated from the sound signal into the base spectrum W and the activation H through non-negative matrix factorization using the set binary mask S by using a sound source separating unit.

(6) A computer-readable non-transitory storage medium according to one aspect of the present invention having a program stored thereon, the program causing a computer in a sound source separating device separating a specific sound source from a sound signal by decomposing a spectrogram generated from the sound signal into a base spectrum and an activation through non-negative matrix factorization to execute: acquiring the sound signal including mixed sounds from a plurality of sound sources; acquiring start information representing a start timing of at least one sound source among the plurality of sound sources; and separating a specific sound source from the sound signal by setting a binary mask controlling presence of the sound source using a variable of "0" and "1" and using a Markov chain for the activation H on the basis of the start information and decomposing the spectrogram X generated from the sound signal into the base spectrum W and the activation H through non-negative matrix factorization using the set binary mask S.

According to the aspects (1) to (6) described above, a sound source can be separated from a monaural sound source in which sounds of a plurality of sound sources are mixed with higher accuracy than in a conventional case. In addition, according to the aspects (1) to (6) described above, for example, by only performing an operation of attaching a mark to a portion at which a target sound source appears for a part of a signal that a user desires to separate in preprocessing, the sound source to which the mark has been attached can be separated and extracted. In addition, according to the aspects (1) to (6), a teacher sound source is unnecessary, and there is an advantage that a user's load is small.

DETAILED DESCRIPTION OF THE INVENTION

Hereinafter, an embodiment of the present invention will be described with reference to the drawings.

Figure 1:
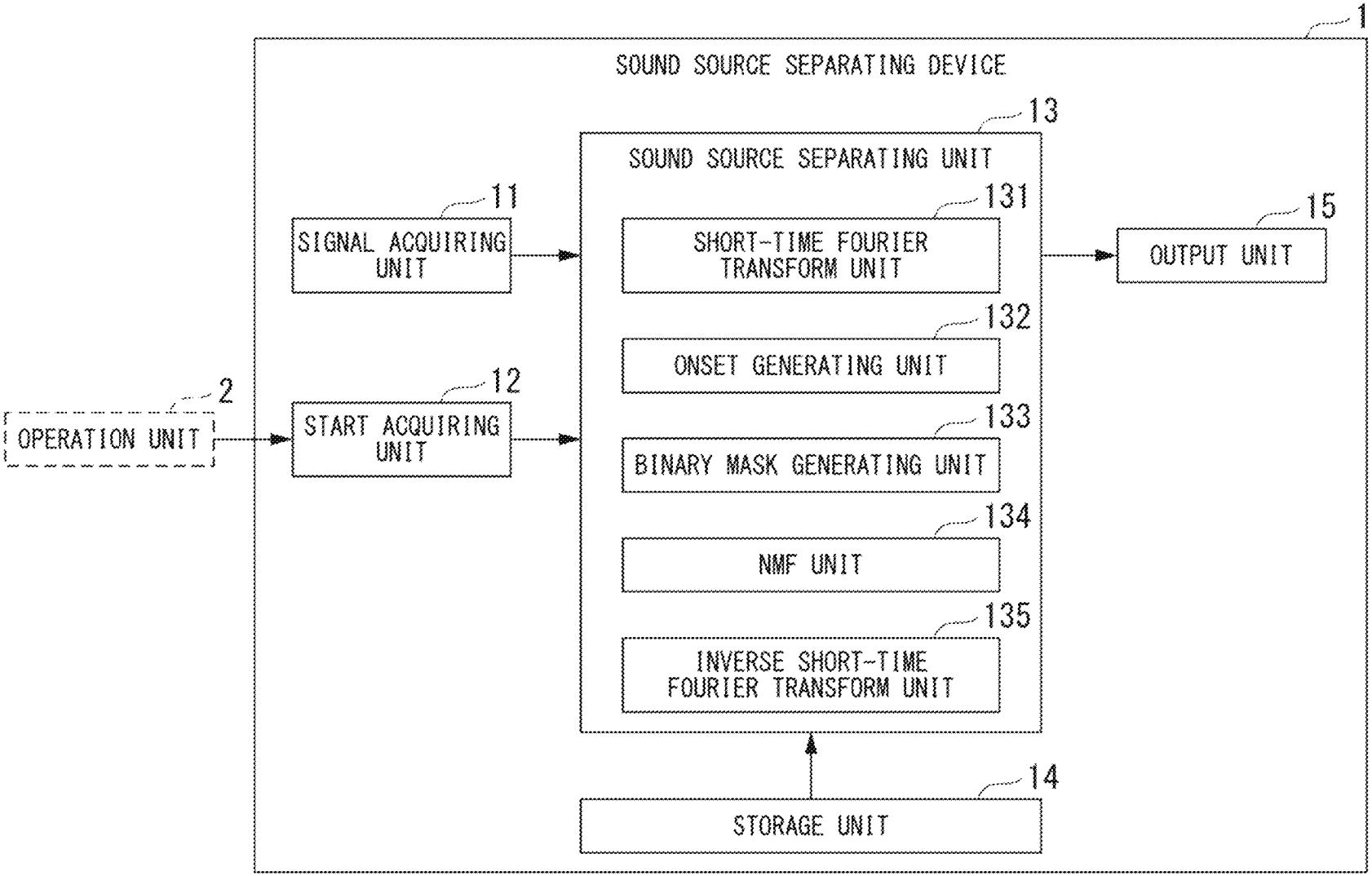
FIG. 1 is a block diagram illustrating an example of the configuration of a sound source separating device according to an embodiment.

FIG. 1 is a block diagram illustrating an example of the configuration of a sound source separating device 1 according to this embodiment. As illustrated in FIG. 1, the sound source separating device 1 includes a signal acquiring unit 11, a start acquiring unit 12, a sound source separating unit 13, a storage unit 14, and an output unit 15.

In addition, the sound source separating unit 13 includes a short-time Fourier transform unit 131, an onset generating unit 132, a binary mask generating unit 133, an NMF unit 134, and an inverse short-time Fourier transform unit 135.

An operation unit 2 is connected to the sound source separating device 1 in a wired or wireless manner.

The sound source separating device 1 separates a sound source included in an acquired sound signal using start information input by a user.

The operation unit 2 detects an operation result of an operation performed by a user. Start information representing a start timing of each sound source included in a sound signal is included in the operation result. The operation unit 2 outputs the start information to the sound source separating device 1.

The signal acquiring unit 11 acquires a sound signal and outputs the acquired sound signal to the sound source separating unit 13.

The start acquiring unit 12 acquires start information from the operation unit 2 and outputs the acquired start information to the sound source separating unit 13.

The sound source separating unit 13 separates a sound source for the acquired sound signal using the acquired start information.

The short-time Fourier transform unit 131 performs a short-time Fourier transform (STFT) on a sound signal output by the signal acquiring unit 11, thereby generating a spectrogram through a transform from a time domain to a frequency domain.

The onset generating unit 132 generates an onset matrix I on the basis of the acquired start information. A method for generating an onset and an onset matrix I will be described later in further detail.

The binary mask generating unit 133 generates a binary mask S. The binary mask S and a method for generating the binary mask S will be described later in further detail.

The NMF unit 134 separates a spectrogram of an acquired sound signal into a base spectrum W and an activation H using a model introducing a binary mask and an onset to non-negative matrix factorization. More specifically, the NMF unit 134 separates a sound source by separating a spectrogram of a sound signal acquired using a binary mask S and an onset matrix I into a base spectrum W and an activation H using a model stored by the storage unit 14.

The inverse short-time Fourier transform unit 135 performs an inverse short-time Fourier transform on a separated base spectrum, thereby generating waveform data of a separated sound source. The inverse short-time Fourier transform unit 135 outputs sound source information (the waveform data and the like) as the separated result to the output unit 15.

The storage unit 14 stores a model introducing a binary mask and an onset to non-negative matrix factorization.

The output unit 15 outputs sound source information output by the sound source separating unit 13 to an external device (for example, a display device, a speech recognizing device, or the like).

<Non-Negative Matrix Factorization>

Figure 25:
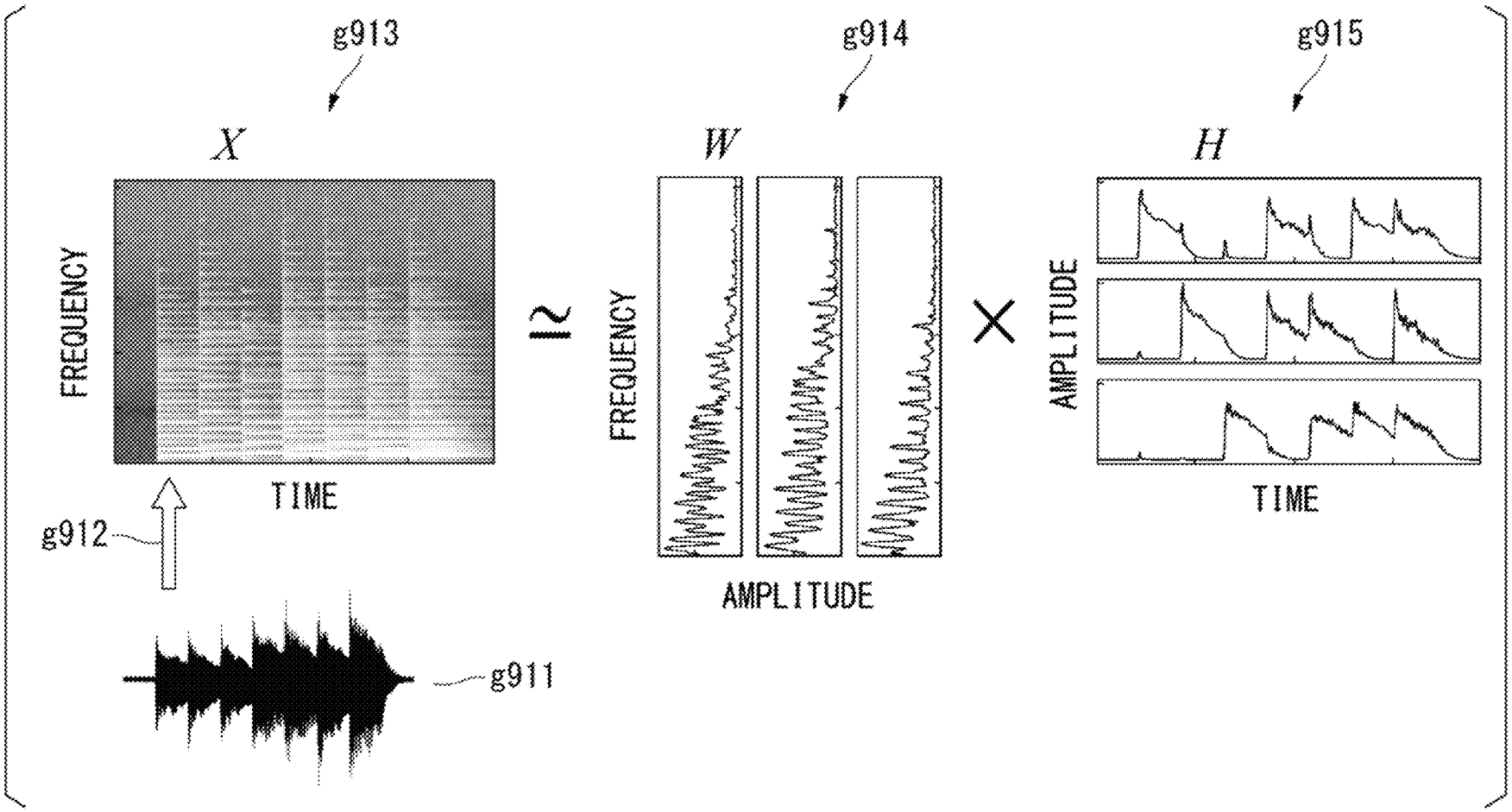
FIG. 25 is a diagram schematically illustrating NMF.

First, an overview of non-negative matrix factorization (NMF) will be described with reference to FIG. 25. Non-negative matrix factorization is an algorithm for decomposing a non-negative matrix into two non-negative matrixes. Here, a non-negative matrix is a matrix of which all the components are equal to or larger than zero. In non-negative matrix factorization in a sound source separating process, for example, a spectrogram (amplitude spectrum) X (∈ R+F×T) g913 acquired by performing a short-time Fourier transform on a monaural mixed sound g911 composed of sounds of a plurality of musical instruments is set as an input. Here, f=1, F is a frequency bin of an amplitude spectrum, and t=1, 2, . . . , T is a time frame. In addition, R+ is a set representing all the non-negative real numbers. In the non-negative matrix factorization, a spectrogram (amplitude spectrum) is approximately decomposed into two non-negative matrixes W(g914) and H(g915) as represented in the following Equation (1).

$$X \cong WH \tag{1}$$

Here, W (∈ R+F×K) is a base spectrum and represents a spectrum pattern of the tone of each musical instrument included in the amplitude spectrum of mixed sounds. The base spectrum is in a form in which a base of a dominant spectrum composing the amplitude spectrum is aligned in a column direction. In addition, H (∈ R+K×T) is an activation and represents a change in the amplitude of the base spectrum with respect to time, i.e., an appearance timing and a magnitude of a sound of each musical instrument. The activation is in a form in which gains of elements of the base spectrum are aligned in a row direction. In addition, k=1, 2, . . . , K represents a base, and the number K of bases may be regarded as the number of sounds composing an amplitude spectrum. Since K cannot be estimated in the non-negative matrix factorization, an appropriate value is assigned thereto in advance.

In addition, in the non-negative matrix factorization, while the spectrogram (amplitude spectrum) X is approximated as a product WH of two matrixes as represented in Equation (1), generally, an error occurs between the two matrixes.

For this reason, as in the following Equation (2), by solving a minimization problem having a "distance" between X and WH as a cost function, W and H are acquired.

$$W, H = \underset{W,H}{\arg\max}\, D(X \mid WH) \tag{2}$$

In Equation (2), D(X|WH) is a cost function and can be represented as in the following Equation (3) by considering each element of a matrix.

$$D(X \mid WH) = \sum_{f=1}^{F} \sum_{t=1}^{T} d(X_{ft} \mid W_{fk} H_{kt}) \tag{3}$$

In Equation (3), d(x|y) is a function representing a distance between x and y, and, for example, a Euclidean distance, a Kullback-Leibler (KL) divergence, an Itakura-Saito distance, or the like is used.

By performing an inverse short-time Fourier transform on an amplitude spectrum composed by each base acquired in this way, a signal of each base can be restored. Although not only an amplitude spectrum but also a phase spectrum is necessary for performing an inverse short-time Fourier transform, a phase spectrum acquired when a short-time Fourier transform is performed on the original signal is used as it is in the non-negative matrix factorization.

However, in a sound signal of a plurality of musical instruments, the sound of each musical instrument appears as a random base for each trial, and accordingly, there is a problem in that the base and the musical instrument do not correspond to one pair. In addition, in a sound signal of a plurality of musical instruments, one musical instrument is not necessarily limited to appearing as one base, and there is also a feature in which the sound is separated into different bases when the heights or the tones of the sound are different even for the same musical instrument. For this reason, in this embodiment, in order to allow an input of an onset (start information of a sound of a musical instrument) in the non-negative matrix factorization, a binary mask performing control of the activation is introduced.

<Beta Process NMF>

First, an overview of beta process NMF (beta process sparse NMF (BP-NMF), i.e., NMF in which a binary mask (see the following Reference Literature 1) is introduced will be described.

Reference Literature 1: "Beta Process Non-negative Matrix Factorization with Stochastic Structured Mean-Field Variational Inference," Dawen Liang, Matthew D Hoffman, arXiv, Vol. 1411.1804, 2014, p 1-6

The beta process NMF has a feature that not only is a binary mask introduced, but also automatic estimation of the number of bases can be performed at the same time. In order to realize this, instead of perceiving a model as a minimization problem in the beta process NMF, an analysis is performed as a Bayes theory problem for estimating a posterior distribution when an amplitude spectrum of an input signal is observed by assuming a prior distribution of each variable.

In the beta process NMF, a binary mask S ($\epsilon\{0, 1\}^{K\times T}$) controlling presence of a sound of a musical instrument using 0/1 variables is introduced in the form of taking an element product with an activation. At this time, an approximate decomposition equation of an amplitude spectrum corresponding to Equation (1) of the non-negative matrix factorization is as in the following Equation (4). In Equation (4), the $\odot$ symbol of "a point in a circle" represents a product of elements of the matrixes W and S.

$$X=W(H\odot S) \tag{4}$$

In the beta process NMF, by giving a prior distribution to each variable represented in Equation (4), a generation model for a spectrogram (amplitude spectrum) X ($\epsilon N+^{F\times T}$; here, N+ is a non-negative natural number) is built. Here, the reason for each element of X being a non-negative real number (which is different from that in general non-negative matrix factorization) is that modeling is performed when each element of X is generated in accordance with a Poisson distribution having a sum of the base spectrum W and the activation H as a parameter.

$$X_{ft}\sim\text{Poisson}\left(\sum_{k=1}^{K} W_{fk}H_{kt}\right) \tag{5}$$

In addition, as represented in the following Equation (6) and Equation (7), each of elements of W and H is generated in accordance with a gamma distribution that is a conjugate prior distribution of the Poisson distribution.

$$W_{fk}\sim\text{Gamma}(a,b) \tag{6}$$

$$H_{kt}\sim\text{Gamma}(c,d) \tag{7}$$

Here, a, b, c, and d are hyper parameters of a gamma distribution. The gamma distribution is a probability distribution represented by a probability density function as in the following Equation (8).

$$\text{Gamma}(x\mid\alpha,\beta)=\frac{\beta^{\alpha}x^{\alpha-1}e^{-\beta x}}{\Gamma(\alpha)} \tag{8}$$

In Equation (8), x>0, $\alpha$>0, and $\beta$>0, and $\Gamma(\bullet)$ is a gamma function. Here, $\alpha$ is a shape parameter representing a shape of a distribution, and $\beta$ is a reciprocal (rate parameter) of a scale parameter representing enlargement of the distribution. When the value of the shape parameter is small, a probability variable may easily take a value close to "0" in the gamma distribution. For this reason, in order to cause sparseness in the base spectrum and the activation, a small value is given to the shape parameter.

Next, a prior distribution is introduced to a binary mask. The binary mask is a hard mask according to values of "0" and "1." Each element of the binary mask S takes a value of "0" or "1" and thus is generated as in the following Equation (9) in accordance with a Bernoulli distribution having $\pi_k$ as its parameter in each base.

$$S_{kt}\sim\text{Bernoulli}(\pi_k) \tag{9}$$

In addition, as in the following Equation (10), a beta process is introduced to $\pi_k$ as a prior distribution.

$$\pi_k\sim\text{Beta}\left(\frac{a_0}{K},\frac{b_0(K-1)}{K}\right) \tag{10}$$

In Equation (10), $a_0$ and $b_0$ are hyper parameters of the beta process.

In this way, in a case in which a prior distribution is introduced for each variable composing a model, and the entire model is analyzed as a probabilistic generation model of an amplitude spectrum, when an amplitude spectrum is observed, by acquiring a posterior distribution of each variable, each value can be acquired. Although a posterior distribution can be calculated using Bayes' theorem, generally, it is difficult to analytically calculate the posterior distribution due to an influence of normalized items and the like, and accordingly, for example, an expected value is approximately calculated using a variational Bayesian method and various sampling algorithms.

<Non-Negative Matrix Factorization Using Onset in Binary Mask>

Figure 2:
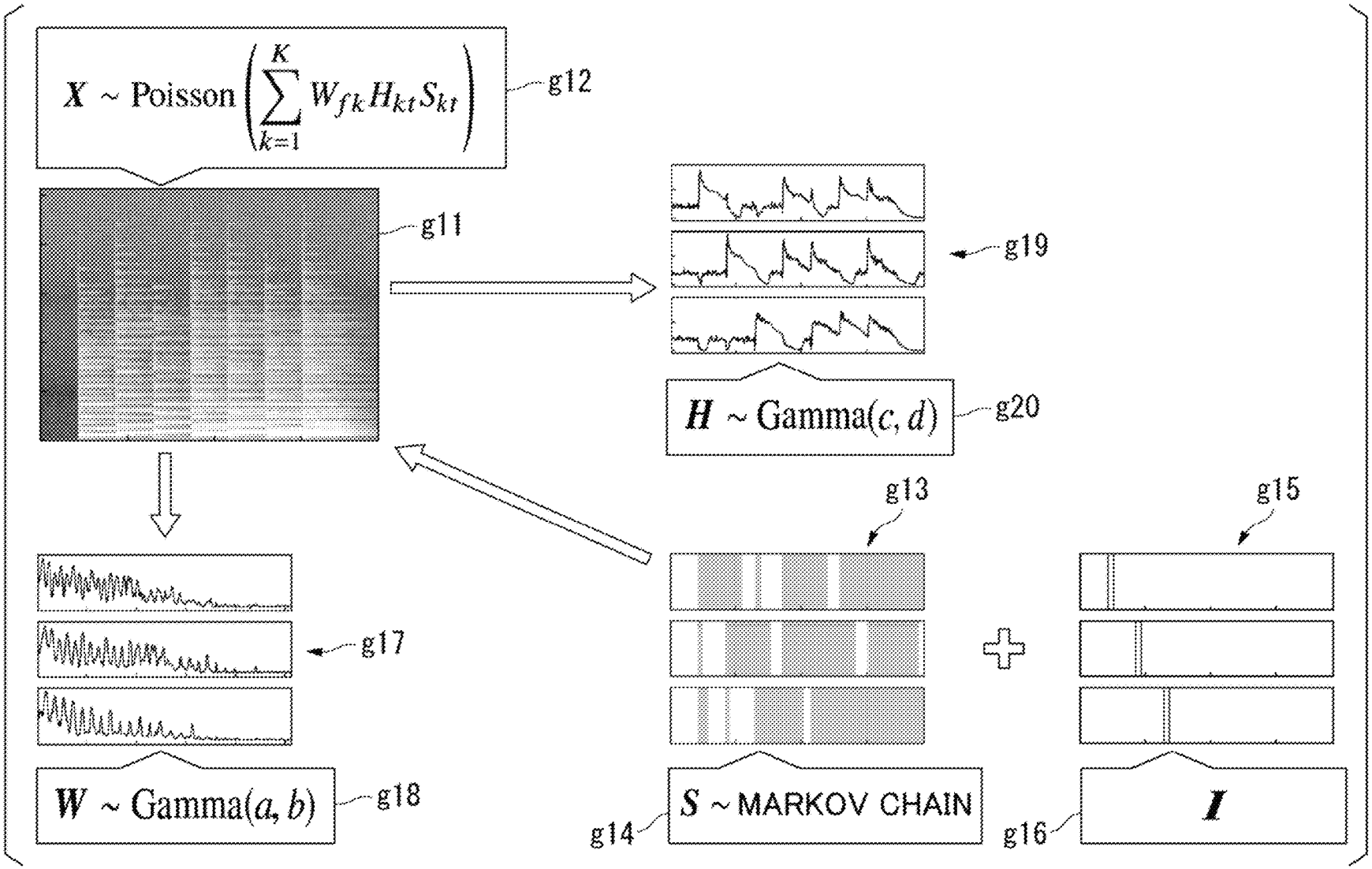
FIG. 2 is a diagram illustrating an overview of a process performed by a sound source separating device according to an embodiment.

FIG. 2 is a diagram illustrating an overview of a process performed by the sound source separating device 1 according to this embodiment. In FIG. 2, spectrograms X g11 and g12 are illustrated, binary masks S g13 and g14 and onsets I g15 and g16 are inputs, and base spectrums W g17 and g18, and activations H g19 and g20 are outputs.

In this embodiment, an amplitude spectrum of a monaural sound signal and a start time (onset) of a sound source that is a separation target are set as inputs, and an amplitude spectrum of a musical instrument sound to which the onset is given is output. The amplitude spectrum is acquired by performing a short-time Fourier transform on a sound signal. As the onset of the musical instrument sound, start information acquired from an operation that a user performs for the operation unit in accordance with a sound generation time of a target musical instrument while actually listening to a musical piece.

The sound source separating unit 13 performs an inverse short-time Fourier transform using an amplitude spectrum of a separated sound and a phase spectrum that is appropriate thereto, thereby acquiring a sound signal of the separated sound. In addition, as the phase spectrum, a phase spectrum of a mixed sound may be used as it is, or a phase spectrum acquired by using a known technique for estimating phase spectrums from an amplitude spectrum may be used.

Figure 3:
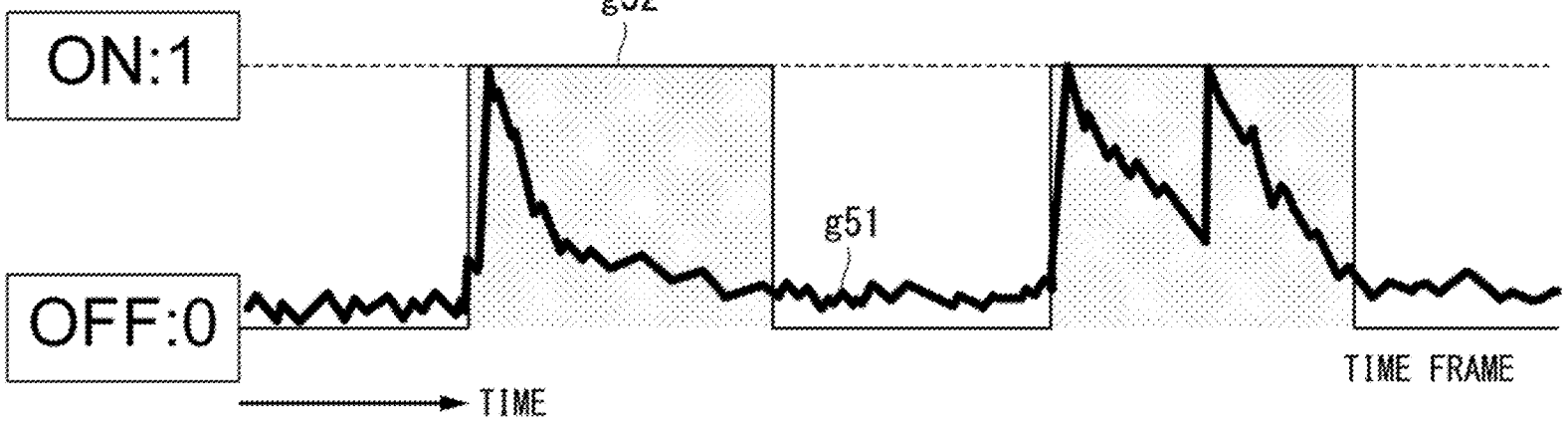
FIG. 3 is a diagram illustrating an activation and a binary mask.

FIG. 3 is a diagram illustrating an activation and a binary mask. In FIG. 3, the horizontal axis represents a time frame, and the vertical axis represents an amplitude of the activation and "0" and "1" of the binary mask. As illustrated in FIG. 3, a low level is set as "0" (off), and a high level is set as "1" (on). Here, the activation g51 and the binary mask g52 are illustrated.

Figure 4:
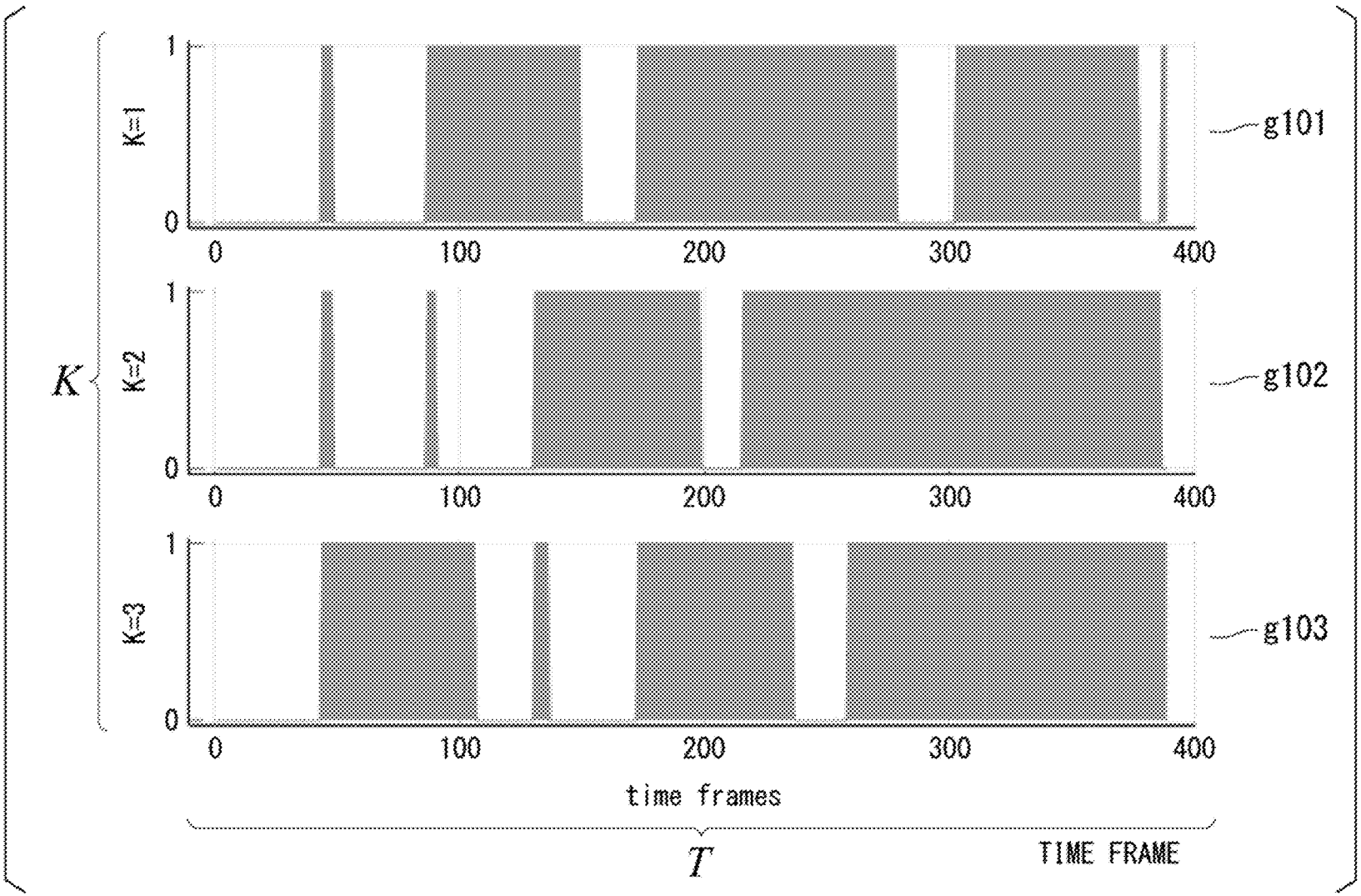
FIG. 4 is a diagram illustrating an example of a binary mask.

FIG. 4 is a diagram illustrating an example of a binary mask. In FIG. 4, the horizontal axis represents a time frame, and the vertical axis represents "0" and "1" of the binary mask. In addition, K=1 to 3 is the number K of bases and is the tone composing the amplitude spectrum. As illustrated in FIGS. 2 and 3, the binary mask is generated for each sound source. As illustrated in FIG. 2, an onset is generated for each sound source.

Next, a method of generating a binary mask will be described.

Figure 5:
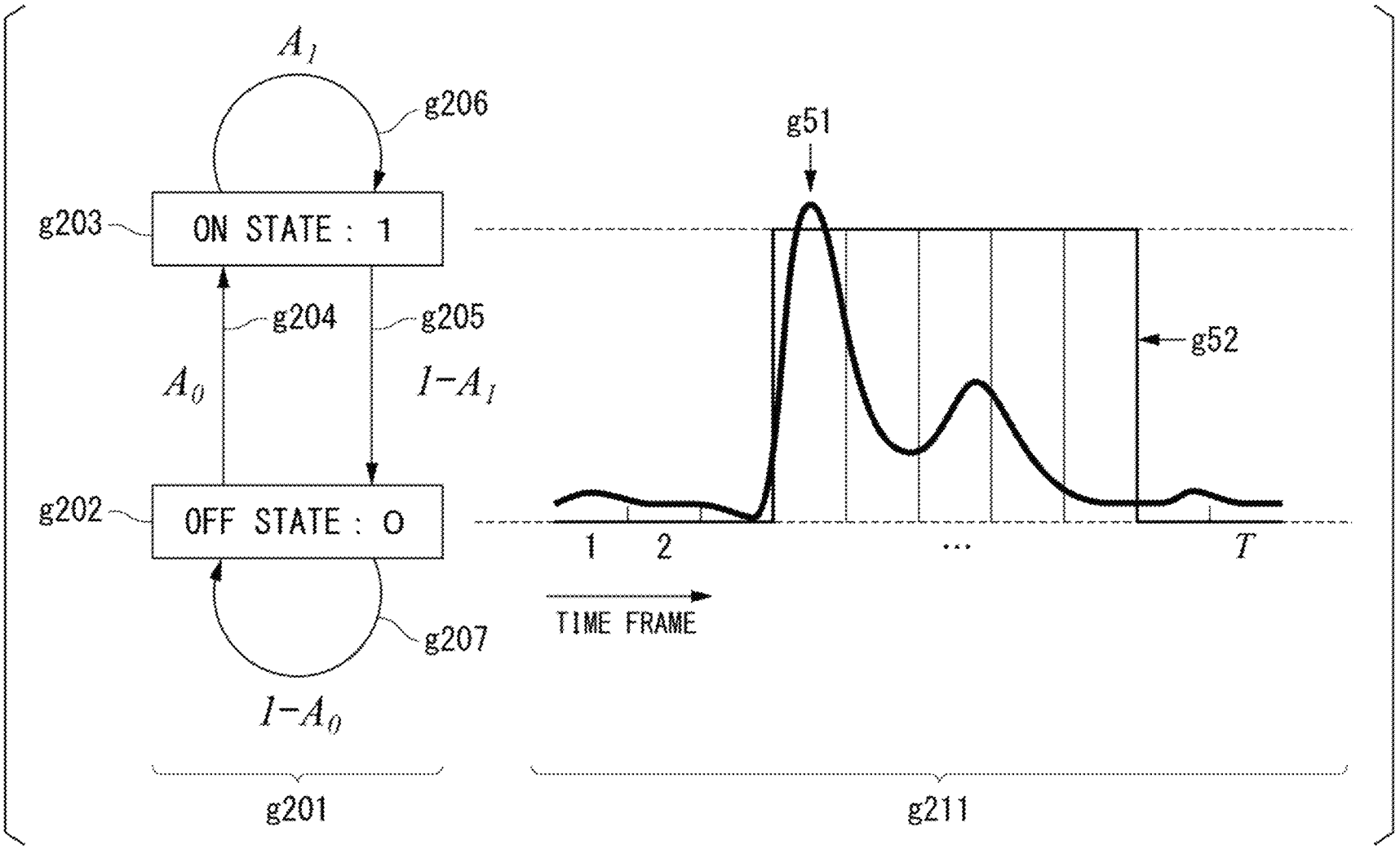
FIG. 5 is a diagram illustrating a method of generating a binary mask.

FIG. 5 is a diagram illustrating a method of generating a binary mask. A state transition diagram g201 and a binary mask g211 are illustrated. In the following description, a case in which a recorded sound source is a musical instrument sound will be described.

A binary mask models each base using a Markov chain on the basis of a musical process in which a musical instrument sound continues for a certain degree of time according to a type of musical instrument. When the musical instrument sound is generated and the activation takes a large value, the value of the binary mask becomes "1." This will be referred to as an on state (gg203) of the binary mask. On the other hand, when a musical instrument sound is not generated, and the activation takes a very small value, the value of the binary mask becomes "0." This will be referred to as an off state (g202) of the binary mask.

Each element of the binary mask transitions between these two states depending on the value of the binary mask of the previous time frame. At this time, a probability of a transition from the off state to the on state is denoted by $A_0$ ($\epsilon(0, 1)$) (g204), a probability of a transition from the on state to the off state is denoted by $A_1$ ($\epsilon$ (0, 1)) (g206), and the state of the binary mask of an initial time frame is determined using an initial probability $\varphi$ ($\epsilon(0, 1)$). The probability of a transition $1-A_1$ (g205) from the on state to the off state and the probability of a transition $1-A_0$ (g207) from the off state to the on state are illustrated in the drawing.

When the binary mask is in the on state, i.e., in a state in which a musical instrument sound is being generated, it is assumed that the probability $A_1$ that a next time frame will be generated as well is high, and the probability $1-A_1$ that the musical instrument sound will stop and the binary mask will transition to the off state is low. In addition, when the binary mask is off, i.e., a state in which no musical instrument sound is being generated, it is assumed that the probability $1-A_0$ that no next time frame will be generated as well is high, and the probability $A_0$ that a musical instrument sound will be generated and the binary mask will transition to the on state is low.

For this reason, a large value is set for A1, and a small value is set for A0 in advance. More specifically, $A_1=0.99$, and $A_0=0.01$.

A joint probability of each base $S_k$ (here, k=1, 2, . . . , K) of a binary mask modeled using such a Markov chain is represented as in the following Equation (11).

$$p(S_k) = p(S_{k1})\prod_{t=2}^{T} p(S_{kt} \mid S_{kt-1}) \tag{11}$$

Accordingly, the joint probability of the entire binary mask is represented as in the following Equation (12).

$$p(S) = \prod_{k=1}^{K} p(S_k) = \prod_{k=1}^{K} p(S_{k1})\prod_{t=2}^{T} p(S_{kt} \mid S_{kt-1}) \tag{12}$$

Here, $p(S_{kt}|S_{kt-1})$ is a probability distribution followed by elements of the initial time frames t=2, 3, . . . , T of each base of a binary mask. The binary mask takes two values of "0" and "1," and thus the probability distribution can be represented using a Bernoulli distribution having an initial probability $\varphi$ as its parameter as in the following Equation (13).

$$p(S_{kt}) \sim \text{Bernoulli}(\varphi) \tag{13}$$

In addition, $p(S_{kt}|S_{kt-1})$ is a probability distribution followed by elements of time frames t=2, 3, . . . , T of each base of the binary mask and can be represented using a Bernoulli distribution having a parameter $A_0$ as its parameter when the value at the previous time frame is "0" and having a parameter $A_1$ as its parameter when the value at the previous time frame is "1." For this reason, $p(S_{kt}|S_{kt-1})$ is represented as a product of two Bernoulli distributions as in the following Equation (14).

$$p(S_{kt}|S_{kt-1}) = \text{Bernoulli}(A_1)^{S_{kt-1}} \cdot \text{Bernoulli}(A_0)^{1-S_{kt-1}} \tag{14}$$

<Description of Onset>

Next, an onset will be described.

Figure 6:
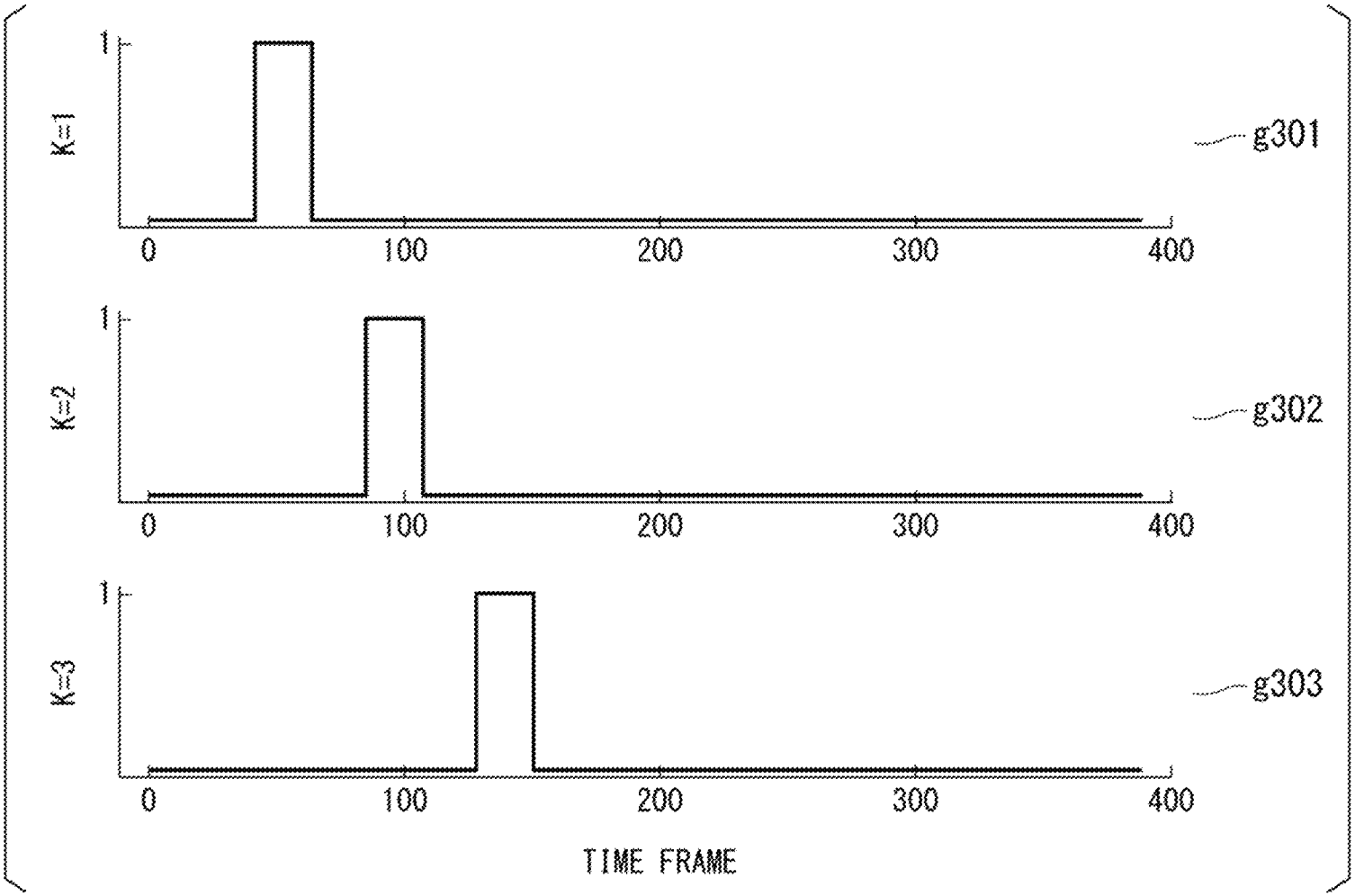
FIG. 6 is a diagram illustrating an example of an onset.

FIG. 6 is a diagram illustrating an example of an onset. In FIG. 6, the horizontal axis represents a time frame, and the vertical axis represents presence (1) or absence (0) of an onset. In addition, onsets g301 to g303 corresponding to start sound sources included in a sound signal are illustrated.

Next, the relationship between an onset and an activation and the relationship between an onset and a binary mask will be described.

Figure 7:
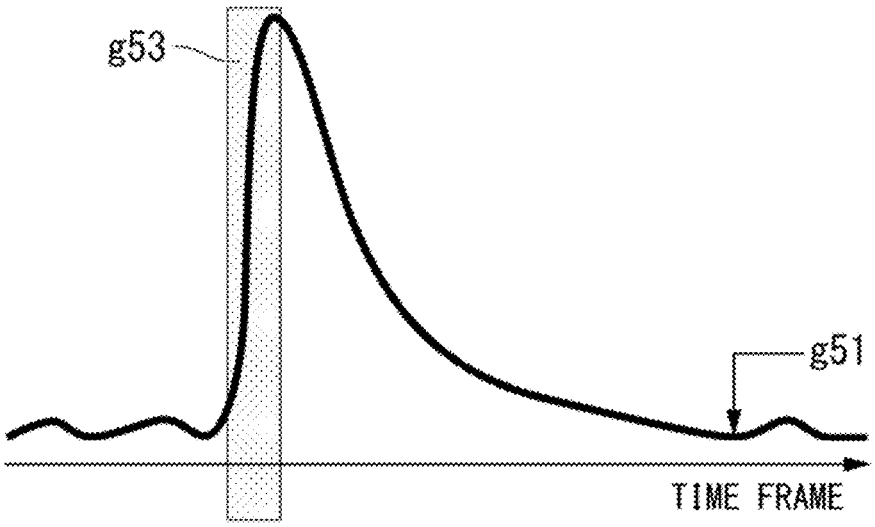
FIG. 7 is a diagram illustrating a relationship between an onset and a binary mask.
Figure 8:
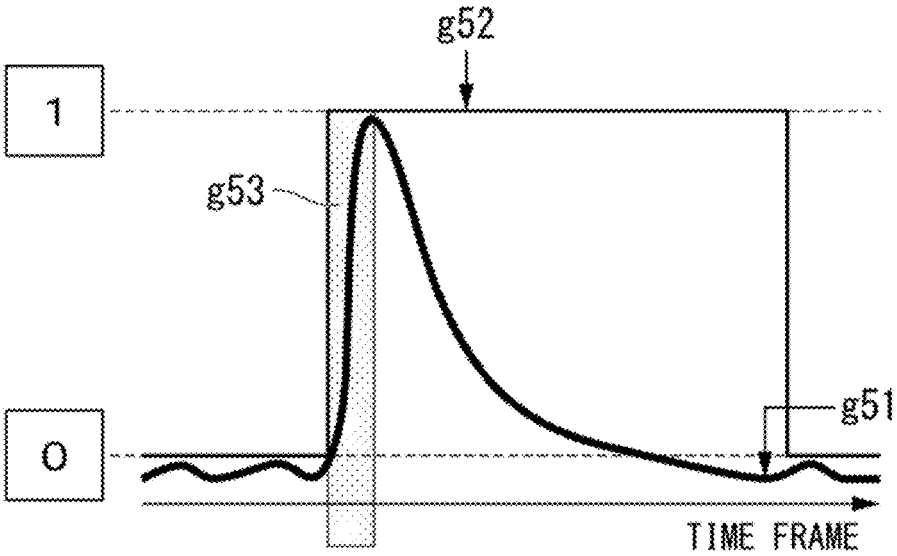
FIG. 8 is a diagram illustrating an onset matrix.

FIG. 7 is a diagram illustrating a relationship between an onset and an activation. FIG. 8 is a diagram illustrating a relationship between an onset and a binary mask. In FIGS. 7 and 8, the horizontal axis represents a time frame, and the vertical axis represents the amplitude of an activation or the state of a binary mask. In FIGS. 7 and 8, an activation g51, a binary mask g52, and an onset g53 are illustrated.

As illustrated in FIG. 7, the onset corresponds to a change of the activation from a value close to "0" to a larger value. For this reason, in order to input an onset of a musical instrument to non-negative matrix factorization, an appropriate value may be given to an element of a time frame corresponding to a sound generation time of the musical instrument of an activation. However, according to features of the non-negative matrix factorization, this value is determined by values of corresponding elements of an amplitude spectrum and a base spectrum, and accordingly, it is difficult to give information of the magnitude of the onset as a valid value.

For this reason, in this embodiment, in order to perform separation using only time information (a sound generation time) of the onset, a binary mask representing presence/absence (on/off) of sound generation of a musical instrument as binary values of 1/0 is introduced to the activation. In this embodiment, the onset is input by being regarded as not an activation but a change of the binary mask from "0" to "1" as illustrated in FIG. 7.

In this embodiment, a model is built on the basis of the BP-NMF described above using a binary mask. Approximate decomposition of an amplitude spectrum is defined as in Equation (4), and, as represented in Equations (5) to (7), a prior distribution similar to the BP-NMF is introduced to an amplitude spectrum, a base spectrum, and an activation.

When the sound desired to be separated is a musical instrument sound, the number of bases depends on the number of musical instrument sounds desired to be separated, and accordingly, automatic estimation of the number of bases is unnecessary. For this reason, in a prior distribution of a binary mask, a Markov chain is used instead of a beta process such that it can be simply handled in consideration of a more musical structure. Furthermore, by representing an onset in a matrix form and auxiliary using the onset for calculating a posterior distribution of a binary mask, a musical instrument sound corresponding to the given onset is separated.

Next, an onset matrix will be described.

Figure 9:
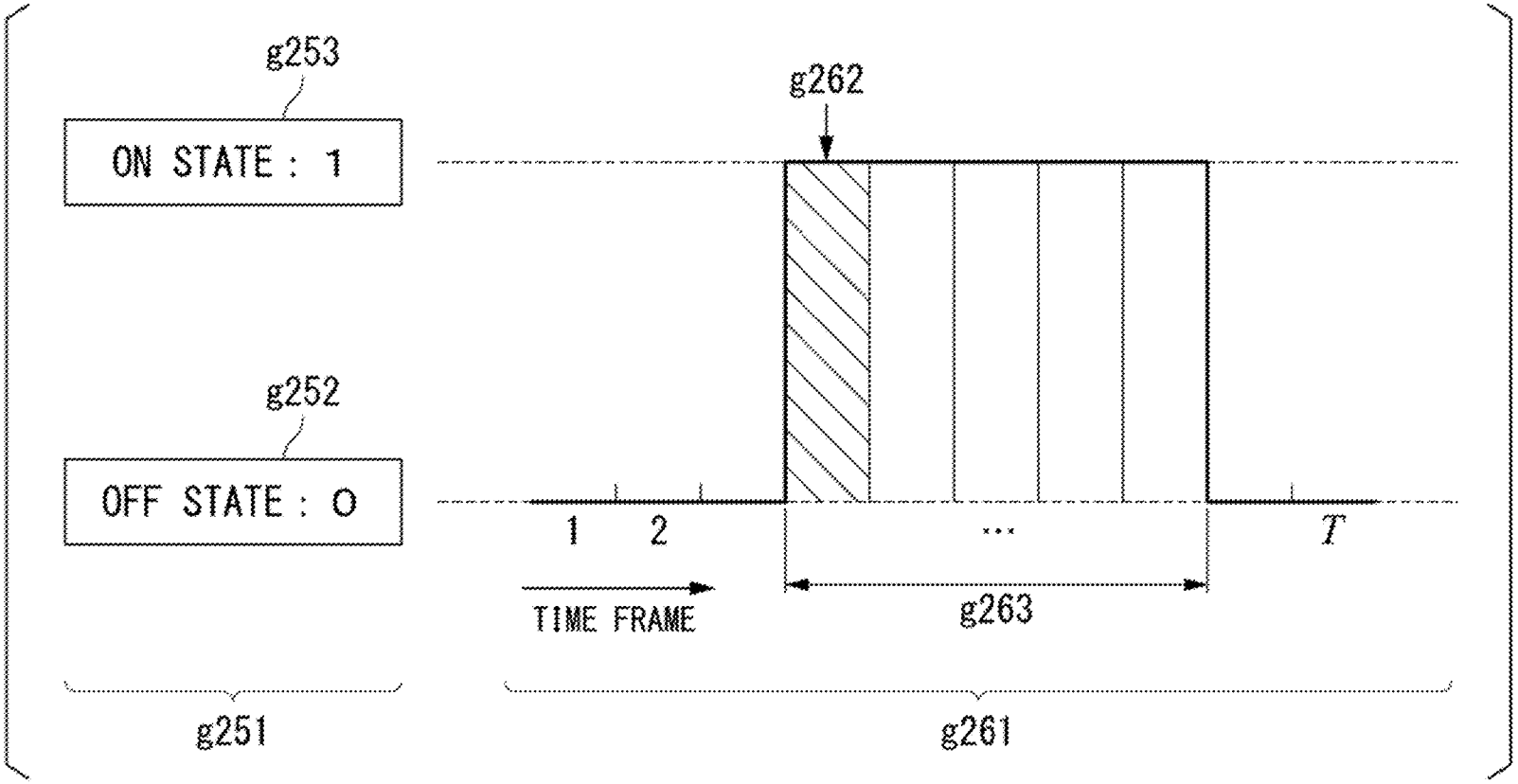
FIG. 9 is a diagram illustrating a relationship between an onset and an activation.

FIG. 9 is a diagram illustrating an onset matrix. States g251 to g253 are illustrated, and a diagram g261 for illustrating an onset matrix is illustrated. In the diagram g261, the horizontal axis represents a time frame, and the vertical axis represents an on state and an off state. In addition, a start frame g262 is illustrated, and a continuation frame g263 is illustrated.

Here, as in the following Equation (15), the onset matrix I has the same size as that of the binary mask and is a binary matrix in which each element has a value of "0" or "1".

$$I \in \{0,1\}^{K \times T} \tag{15}$$

When an onset matrix is generated, first, a start frame of the onset is determined. In this embodiment, it is assumed that the start frame is given by a user or the like and is known. As illustrated in FIG. 9, a form in which "1" is continued between the start frame and a specific frame is used. The reason is on the basis of an assumption that a musical instrument sound of which an onset is given does not end only in one frame and is continued for a predetermined number of frames. In addition, the length of continuation frames needs to be determined in advance.

This onset matrix is not included in the probability model of the NMF and is indirectly used to assist estimation of a binary mask in Gibbs sampling (which will be described later) estimating each variable.

<Sampling of Model>

For a model according to this embodiment (a model in which a binary mask and an onset are introduced to the NMF), under observation of the spectrogram (the amplitude spectrum) X and the onset matrix I, a posterior distribution p(W, H, S|X) is estimated. While this posterior distribution can be acquired using the following Equation (16), it is difficult to calculate a normalized term p(X), and accordingly, it is difficult to directly acquire the posterior distribution.

$$p(W, H, S \mid X) = \frac{p(W, H, S, X)}{p(X)} \tag{16}$$

For this reason, in this embodiment, an expected value of each probability variable is evaluated instead of acquiring the posterior distribution. In this embodiment, a base spectrum, an activation, and an expected value of a binary mask are acquired using the Gibbs sampling. Here, the Gibbs sampling is one of Markov chain Monte Carlo (MCMC) methods that are sampling techniques. In the Gibbs sampling, a sample sequence is generated by substituting one variable for each step. At this time, as a substituting value, a value extracted from a conditional distribution of a target in a condition in which values other than a variable to be substituted are fixed is used. As an example, a method of acquiring an expected value of z from a probability distribution p(z)=p(z1, z2, z3) using Gibbs sampling will be described.

First, variables $z_1$, $z_2$, and $z_3$ are appropriately initialized. Thereafter, in the (i+1)-th step, when values of $z_1^{(i)}$, $z_2^{(i)}$, and $z_3^{(i)}$ are acquired in the previous step, first, $z_i^1$ is substituted with $z_1^{(i+1)}$ extracted from the conditional distribution of the following Equation (17).

$$z_1^{(i+1)} \sim p(z_1 \mid z_2^{(i)}, z_3^{(i)}) \tag{17}$$

Next, as in the following Equation (18), $z_2^{(i+1)}$ is extracted using the extracted $z_1^{(i+1)}$ and is substituted into $z_2^{(i)}$.

$$z_2^{(i+1)} \sim p(z_2 | z_1^{(i+1)}, z_3^{(i)}) \tag{18}$$

Next, as in the following Equation (19), $z_3^{(i+1)}$ is extracted using the extracted $z_2^{(i+1)}$ and is substituted into $z_3^{(i)}$.

$$z_3^{(i+1)} \sim p(z_3 | z_1^{(i+1)}, z_2^{(i+1)}) \tag{19}$$

By taking an average of sample sequences ($z_1^{(i)}$, $z_2^{(i)}$, $z_3^{(i)}$), . . . , ($z_1^{(N)}$, $z_2^{(N)}$, $z_3^{(N)}$) acquired by repeating such a process, an expected value of the probability variable is approximated. However, the value of the variable may not converge in the initial period of the sample sequence, and accordingly, a period called a burn-in in which a sample sequence is discarded is taken. In addition, since the Gibbs sampling is a technique based on a Markov chain, in order to eliminate influences of correlations between variables adjacent to each other, values for every predetermined number of samples are used for calculating an expected value.

In a model according to this embodiment, probability variables desired to be acquired are a base spectrum W, an activation H, and a binary mask S. For this reason, in order to calculate a conditional distribution in a simple manner, as in the following Equation (20), an auxiliary variable Z∈NF×T×K (here, N is a set of natural numbers) is introduced.

$$z_{fik} \sim \text{Poisson}(W_{fk} H_{kt} S_{kt}) \tag{20}$$

In accordance with the introduction of the auxiliary variable Z, a spectrogram (amplitude spectrum) $X_{ft}$ can be represented as a sum of bases of $Z_{fk}$ as in the following Equation (21).

$$X_{ft} = \sum_{k=1}^{K} Z_{ftk} \tag{21}$$

In accordance with the introduction of the auxiliary variable Z, a sampling equation of each variable of Gibbs sampling in the model is as in the following Equations (22) to (25).

$$Z^{(i+1)} \sim p(Z | W^{(i)}, H^{(i)}, S^{(i)}, X) \tag{22}$$

$$W^{(i+1)} \sim p(W | Z^{(i+1)}, H^{(i)}, S^{(i)}, X) \tag{23}$$

$$H^{(i+1)} \sim p(H | Z^{(i+1)}, W^{(i+1)}, S^{(i)}, X) \tag{24}$$

$$S^{(i+1)} \sim p(S | Z^{(i+1)}, W^{(i+1)}, H^{(i+1)}, X) \tag{25}$$

Figure 10:
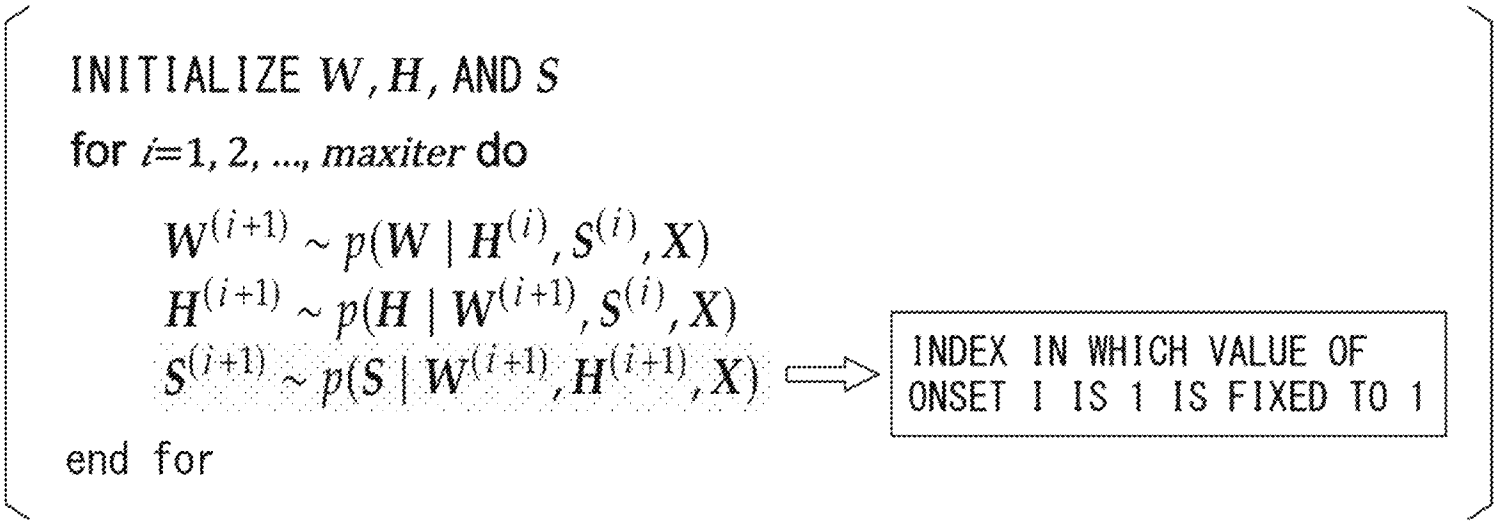
FIG. 10 is a diagram illustrating an algorithm for acquiring W, H, and S using Gibbs sampling.

In this embodiment, as represented in FIG. 10, approximate calculation of expected values is performed by forming a sample sequence by repeatedly extracting values of the variables using these four sampling Equations (22) to (24). FIG. 10 is a diagram illustrating an algorithm for acquiring W, H, and S through Gibbs sampling.

When a conditional distribution of the sampling equation is derived, a joint probability p(X, Z, W, H, S) of the entire model is necessary. As a technique for representing dependency of probability variables as directed graphs, there is a graphical model.

Figure 11:
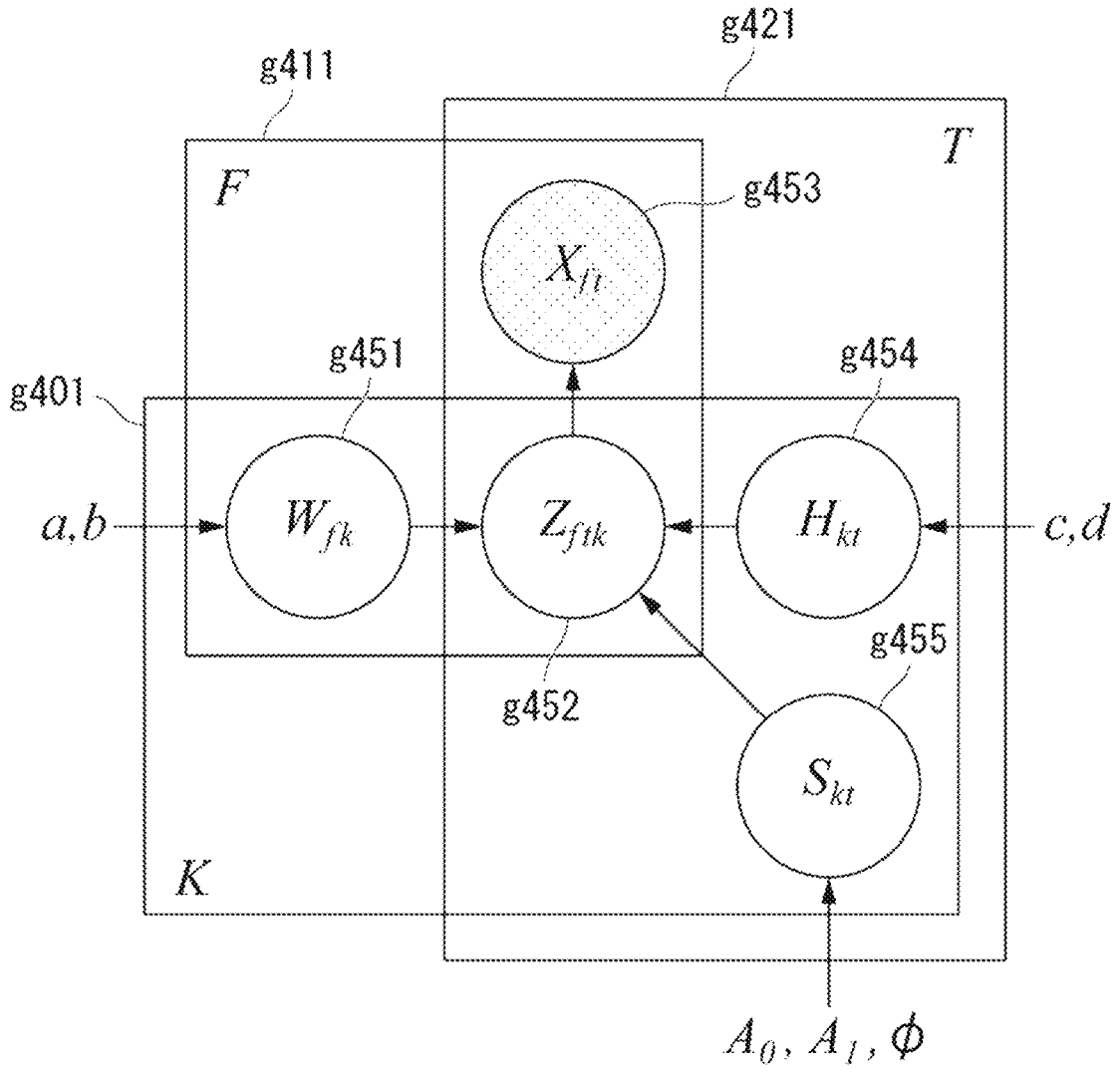
FIG. 11 is a diagram illustrating a model according to an embodiment using a graphical model.

By using a graphical model, the dependency of element levels of variables in a model can be represented as in FIG. 11.

FIG. 11 is a diagram illustrating a model according to this embodiment as a graphical model. In FIG. 11, a node g453 represents a variable that has been observed, and nodes g451, g452, g454, and g455 represent variables that have not been observed. A relationship represented by a conditional distribution p(x|y) is represented using an arrow directed from a y node to an x node. In addition, a rectangular plate enclosing a node represents repetition of a number of times denoted by a character (F, T, or K) written at the corner thereof.

In FIG. 11, φ is an initial probability, $A_1$ is a probability of a transition from the off state to the on state (FIG. 5), and $A_0$ is a probability of a transition from the on state to the off state (FIG. 5).

Accordingly, the joint probability of the entire model can be represented in a decomposed form as illustrated in the following Equation (26).

$$p(X,Z,W,H,S)=p(X|Z)p(Z|W,H,S)p(W)p(H)p(S) \tag{26}$$

Each term of Equation (26) is represented using a prior distribution of each variable, and thus a sampling equation is derived using this equation.

When the auxiliary variable Z is sampled, an auxiliary variable Z composed using the vector $Z_{ft}$ acquired using Equation 27 for the base k=1, 2, . . . , K is used as a result of the sampling.

$$Z_{ft} \sim Mult\left(Z_{ft} \mid X_{ft}, \frac{W_{fk}H_{kt}S_{kt}}{\sum_l W_{fl}H_{lt}S_{lt}}\right) \tag{27}$$

In Equation (27), Mult(x|n, p) is a polynomial distribution formed by the number of times $x=(x_1, x_2, \ldots, x_K)$ with which k appears when the number of times of performing a trial is n, and a probability at which k=1, 2, . . . , K appears at each trial is $p=(p_1, p_2, \ldots, p_K)$.

In addition, the spectrum W is sampled using the following Equation (28), and the activation H is sampled using the following Equation (29).

$$W_{fk} \sim \text{Gamma}\left(a + \sum_{t=1}^{T} Z_{ftk},\ b + \sum_{t=1}^{T} H_{kt}S_{kt}\right) \tag{28}$$

$$H_{kt} \sim \text{Gamma}\left(c + \sum_{f=1}^{F} Z_{ftk},\ d + S_{kt}\sum_{f=1}^{F} W_{kt}\right) \tag{29}$$

Furthermore, $S_{kt}$ is sequentially sampled starting from a time frame t=1 from a Bernoulli distribution as represented in the following Equation (32) using $P_1$ of the following Equation (30) and $P_0$ of the following Equation (31). Here, $P_1$ and $P_0$ are each likelihoods of an element of the binary mask being "1" and "0". When the binary mask S is sampled, by fixing the value of a corresponding index to "1", the sampling is assisted.

$$P_0 = \begin{cases} (1-\phi)\prod_{f=1}^{F}(X_{ft}^{\neg k})^{X_{ft}} & t=1 \\ \left(1-A_1^{S_{kt-1}}\right)\left(1-A_0^{1-S_{kt-1}}\right)\prod_{f=1}^{F}(X_{ft}^{\neg k})^{X_{ft}} & t=2,3,\ldots,T \end{cases} \tag{30}$$

$$P_1 = \begin{cases} \phi\prod_{f=1}^{F}(X_{ft}^{\neg k}+W_{fk}H_{kt})^{X_{ft}}\exp(-W_{fk}H_{kt}) & t=1 \\ A_1^{S_{kt-1}}A_0^{1-S_{kt-1}}\prod_{f=1}^{F}(X_{ft}^{\neg k}+W_{fk}H_{kt})^{X_{ft}}\exp(-W_{fk}H_{kt}) & t=2,3,\ldots,T \end{cases} \tag{31}$$

$$S_{kt} = \text{Bernoilli}\left(\frac{P_1}{P_1+P_0}\right) \tag{32}$$

In Equations (30) and (31), a sign "⌉" represents negation, and "⌉ k" represents that a proposition k is false.

<Processing Sequence>

Next, a sound source separating sequence of the sound source separating device 1 according to this embodiment will be described.

Figure 12:
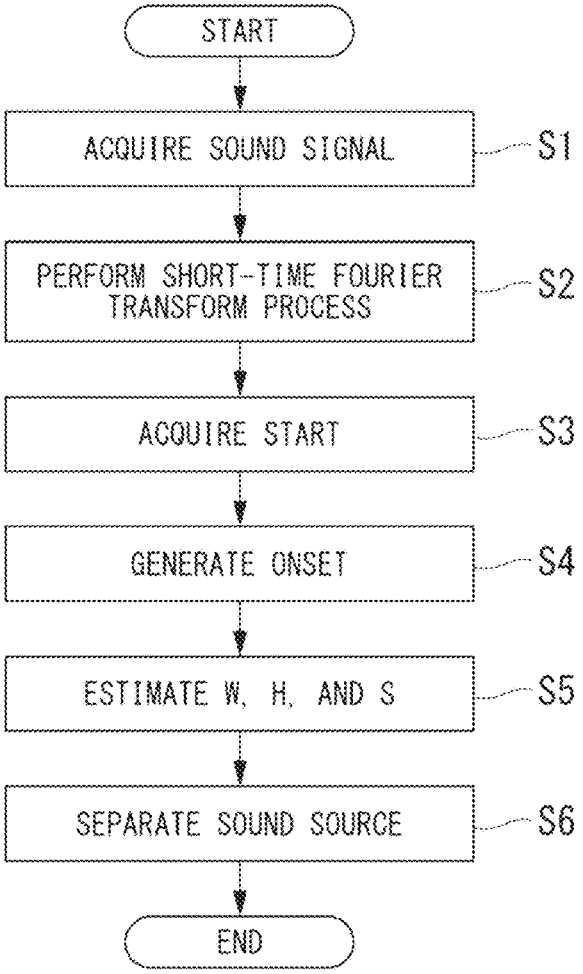
FIG. 12 is a flowchart of a sound source separating process of a sound source separating device according to this embodiment.

FIG. 12 is a flowchart of a sound source separating process of the sound source separating device 1 according to this embodiment.

(Step S1) The signal acquiring unit 11 acquires a sound signal.

(Step S2) The short-time Fourier transform unit 131 generates a spectrogram by performing a short-time Fourier transform on the acquired sound signal.

(Step S3) The start acquiring unit 12 acquires start information output by the operation unit 2.

(Step S4) The onset generating unit 132 generates an onset matrix I on the basis of the start information.

(Step S5) The NMF unit 134 estimates a spectrum W, an activation H, and a binary mask S by indirectly using the onset I to assist estimation of the binary mask S in Gibbs sampling in which the spectrum W, the activation H, and the binary mask S are estimated.

(Step S6) The NMF unit 134 separates a sound source by separating the sound signal into a spectrum W and an activation H using the spectrum W, the activation H, and the binary mask S that have been estimated.

<Evaluation Result>

Next, an example of an evaluation result acquired by evaluating the sound source separating device 1 according to this embodiment will be described.

First, a result of comparing presence/absence of an onset will be described.

Figure 13:
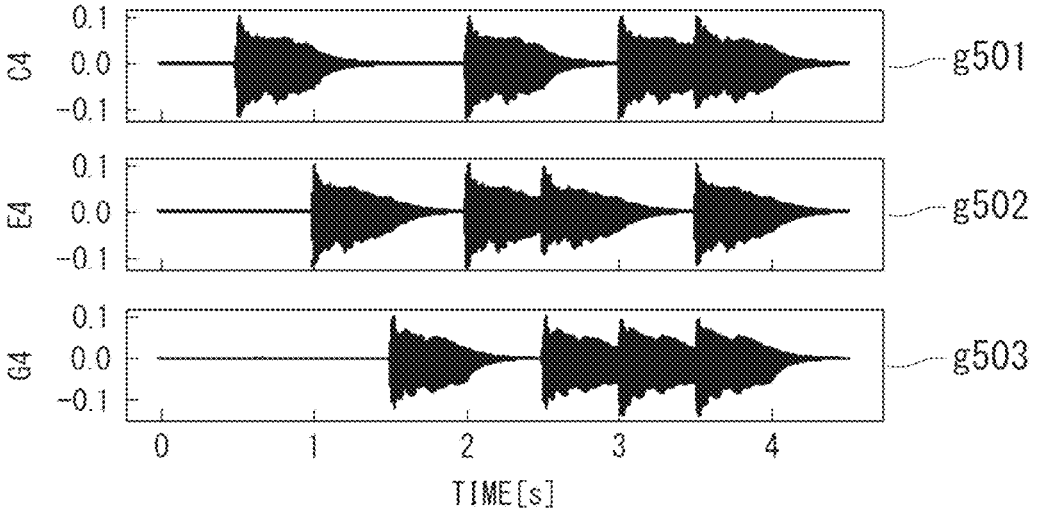
FIG. 13 is a diagram illustrating waveform data of a sound source used for an evaluation.
Figure 14:
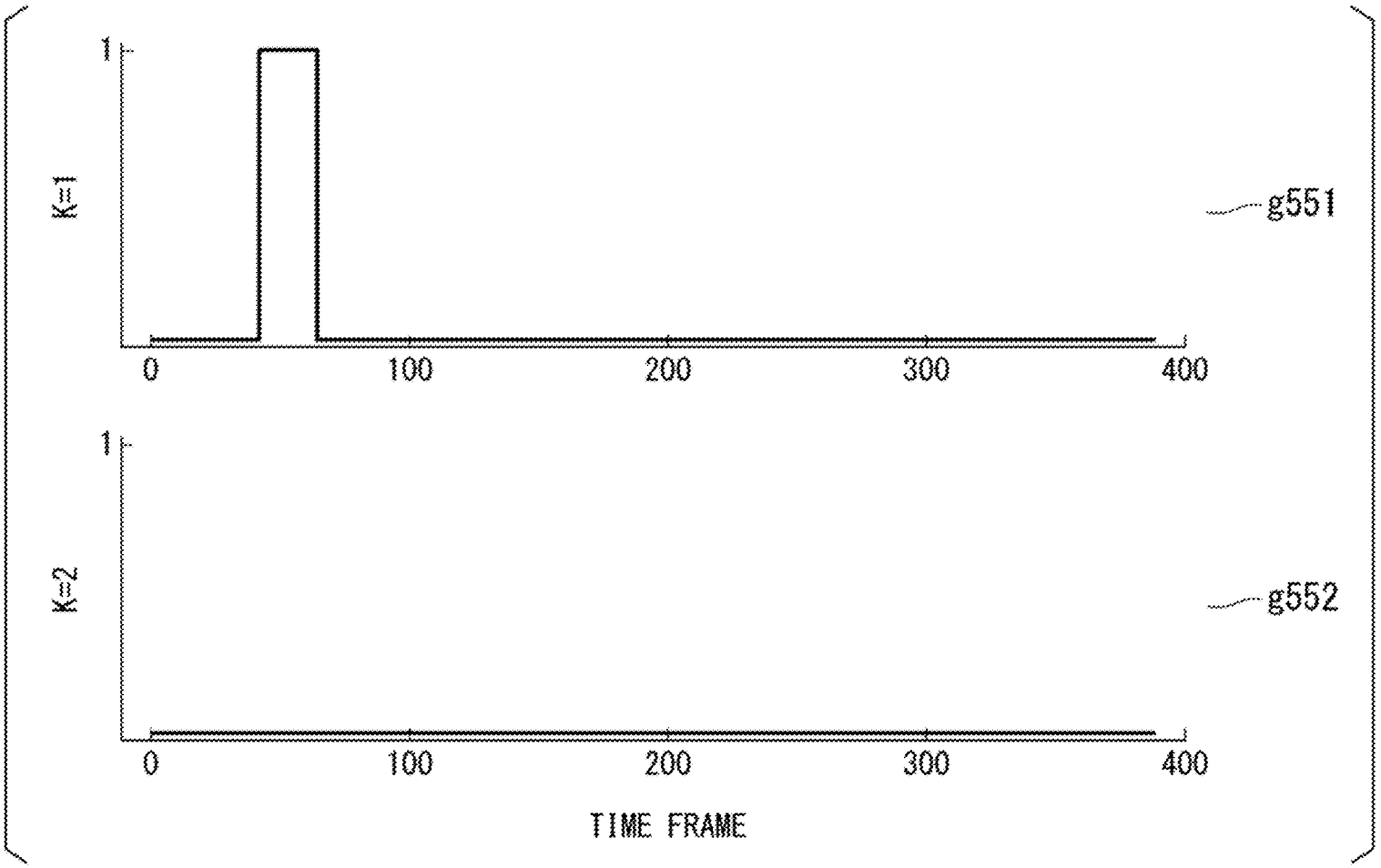
FIG. 14 is a diagram illustrating an example of an onset generated on the basis of start information.

In the evaluation, toy data formed from three sounds from a piano (do (C4), mi (E4), and sol (G4)) illustrated in FIG. 13 was used as a sound signal. In addition, only "do" (C4) was separated in the mixed sound described above, and an evaluation was performed. FIG. 13 is a diagram illustrating waveform data of a sound source used for an evaluation. In FIG. 13, the horizontal axis represents a time frame, and the vertical axis represents a normalized magnitude of the amplitude. In addition, FIG. 14 is a diagram illustrating an example of an onset generated on the basis of start information. In FIG. 14, the horizontal axis represents a time frame, and the vertical axis represents an on state (1) and an off state (0). As illustrated in FIG. 14, only an onset g551 of k=1 corresponding to "do" (C4) of a separation target is generated, and an onset corresponding to k=2 as denoted by a reference sign g552 is not generated.

Figure 15:
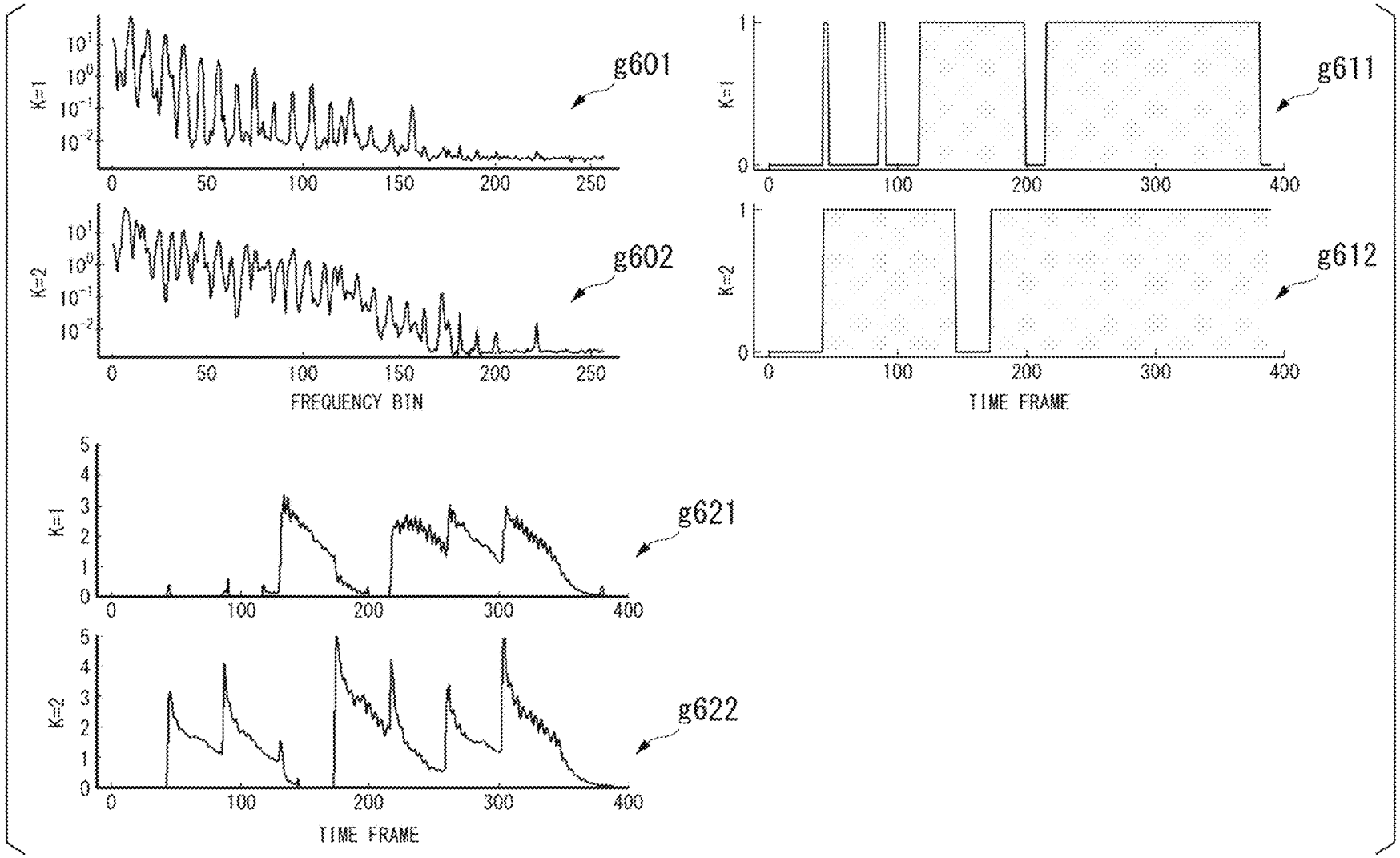
FIG. 15 is a diagram illustrating a base spectrum, a binary mask, and an expected value of an element product of an activation and the binary mask in a case in which no onset is used.

FIG. 15 is a diagram illustrating the base spectrum, the binary mask, and the expected value of an element product of the activation and the binary mask in a case in which no onset was used. In FIG. 15, k=1 and k=2 in a mixed sound are illustrated. Plotted graphs g601, g611, and g621 illustrate the base spectrum, the binary mask, and the expected value of an element product of the activation and the binary mask corresponding to k=1. In addition, plotted graphs g602, g612, and g622 illustrate the base spectrum, the binary mask, and the expected value of an element product of the activation and the binary mask corresponding to k=2.

Figure 16:
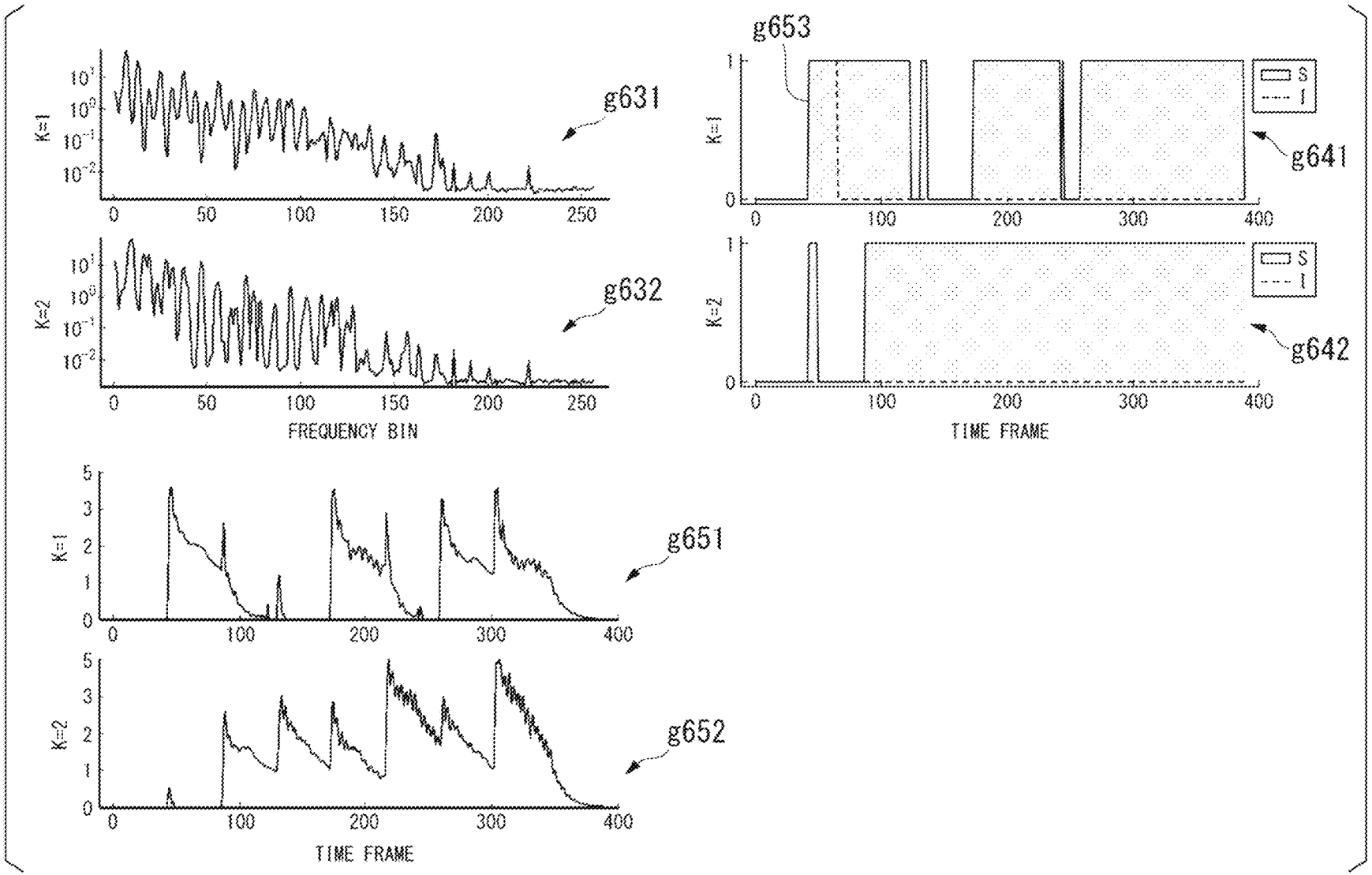
FIG. 16 is a diagram illustrating a base spectrum, a binary mask, and an activation separated using the binary mask in a case in which an onset is used.

FIG. 16 is a diagram illustrating the base spectrum, the binary mask, and the activation separated using the binary mask in a case in which an onset was used. Also in FIG. 16, k=1 and k=2 in a mixed sound are illustrated. The base spectrum g631, the binary mask g641, and the binary mask g651 corresponding to k=1 are illustrated in the drawing. In addition, the base spectrum g632, the binary mask g642, and the binary mask g652 corresponding to k=2 are illustrated in the drawing. Furthermore, the onset g653 is illustrated in the drawing.

In FIGS. 15 and 16, in the graphs g601, g602, g631, and g632, the horizontal axis is the frequency bin, and the vertical axis is amplitude. In the graphs g611, g612, g621, g622, g641, g642, g651, and g652, the horizontal axis is a time frame. In the graphs g611, g612, g641, and g642, the vertical axis represents the binary mask and an on state (1) and an off state (0) of the onset. In the graphs g621, g622, g651, and g652, the vertical axis represents the binary mask and the amplitude of the onset.

As illustrated in FIG. 15, in a case in which no onset was given, the sounds "mi" and "sol" were separated in the base k=1, and the sound "do" was separated in the base k=2. Although this is a result of Gibbs sampling performed once, there is tendency that a random sound will be separated in each base even when the result of sampling performed a plurality of number of times is checked.

As illustrated in FIG. 16, it can be checked that the sound "do" was separated in the base k=1, and the sounds "mi" and "sol" were correctly separated in the base k=2 in a case in which sampling was performed by giving an onset to the start of "do". When an actually separated sound is checked through listening, it can be checked that the sound "do" was separated in the base k=1.

Although this was a result of Gibbs sampling performed once as well, even when a result of sampling performed a plurality of number of times was checked, the sound "do" was separated only in the base k=1 in all the trials. In addition, also in a case in which sampling was performed by giving an onset to all the "do" sounds, it was checked that the sound "do" was separated in the base k=1, and sounds "mi" and "sol" were correctly separated in the base k=2.

As described above, also in a case in which an onset was given only to the start of a sound as in this embodiment, strong separation can be expected.

Next, a result acquired by inputting music data that is more complicated than a piano operation verification sound source, performing separation of a melody of a specific musical instrument sound, and evaluating separation performance thereof will be described.

In the evaluation, a sound signal (a sampling rate of 22020 (Hz)) for about 10 seconds was used. Musical instruments included in this sound signal were four types including a vocal, a piano, a guitar, and a bass. By performing a short-time Fourier transform on the sound signal with having a frame length of 512 samples, a shift width of 256 samples, and a Hanning window as a window function, an amplitude spectrum was generated.

In the evaluation, separation of only a melody was performed by giving an onset of the melody, and hyperparameter were set such that a=b=2, c=d=1, $\varphi$=0.01, A1=0.99, and A0=0.01. In addition, the number K of bases was set to 10 that is a sum of the number of a sound height of melody that is "7" and the number of the other composing musical instruments that is "3".

Figure 17:
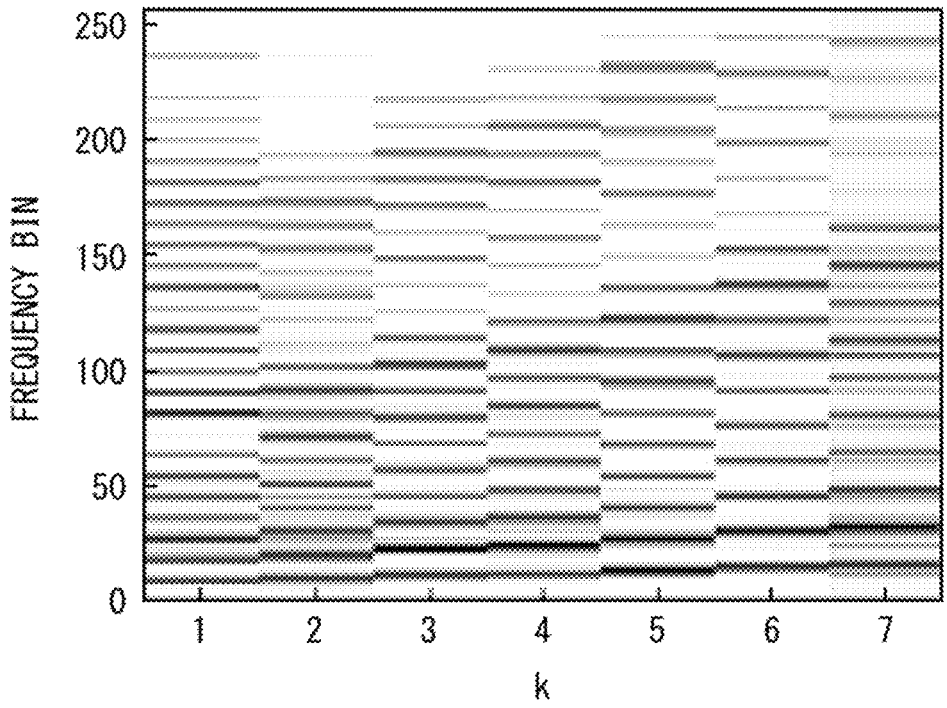
FIG. 17 is a diagram illustrating a base spectrum that has been learned in advance by inputting only a melody.

FIG. 17 is a diagram illustrating a heat map of a base spectrum that has been learned in advance by inputting only a melody. In FIG. 17, the horizontal axis is the number k of bases, and the vertical axis is a frequency bin.

Figure 18:
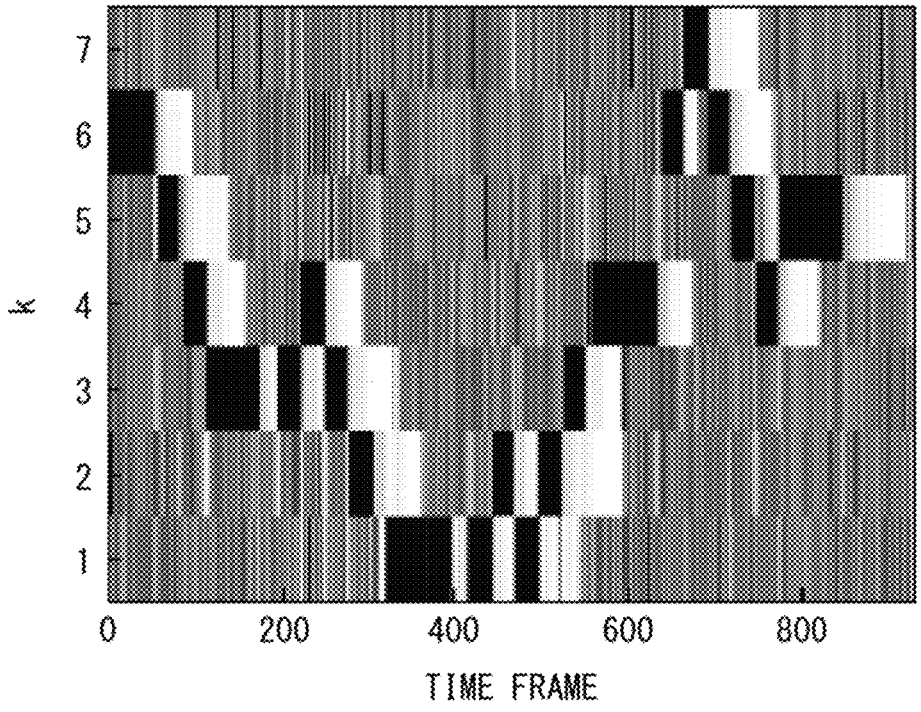
FIG. 18 is a diagram illustrating a heat map of an activation that has been learned in advance by inputting only a melody.

FIG. 18 is a diagram illustrating a heat map of an activation that has been learned in advance by inputting only a melody. In FIG. 18, the horizontal axis represents a time frame, and the vertical axis represents the number k of bases.

Figure 19:
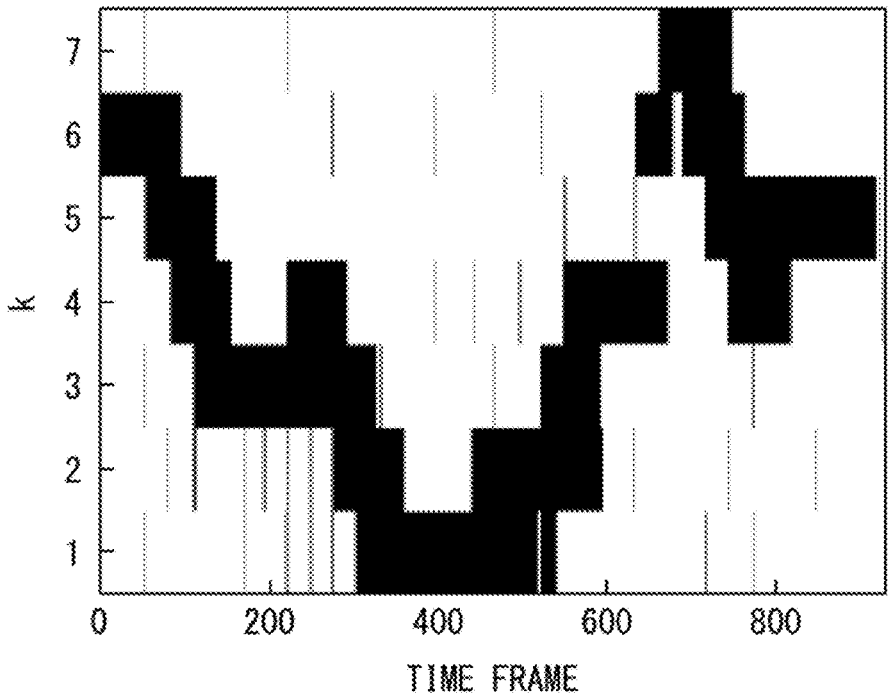
FIG. 19 is a diagram illustrating a heat map of a binary mask that has been learned in advance by inputting only a melody.

FIG. 19 is a diagram illustrating a heat map of a binary mask that has been learned in advance by inputting only a melody. In FIG. 19, the horizontal axis represents a time frame, and the vertical axis represents the number k of bases.

Figure 20:
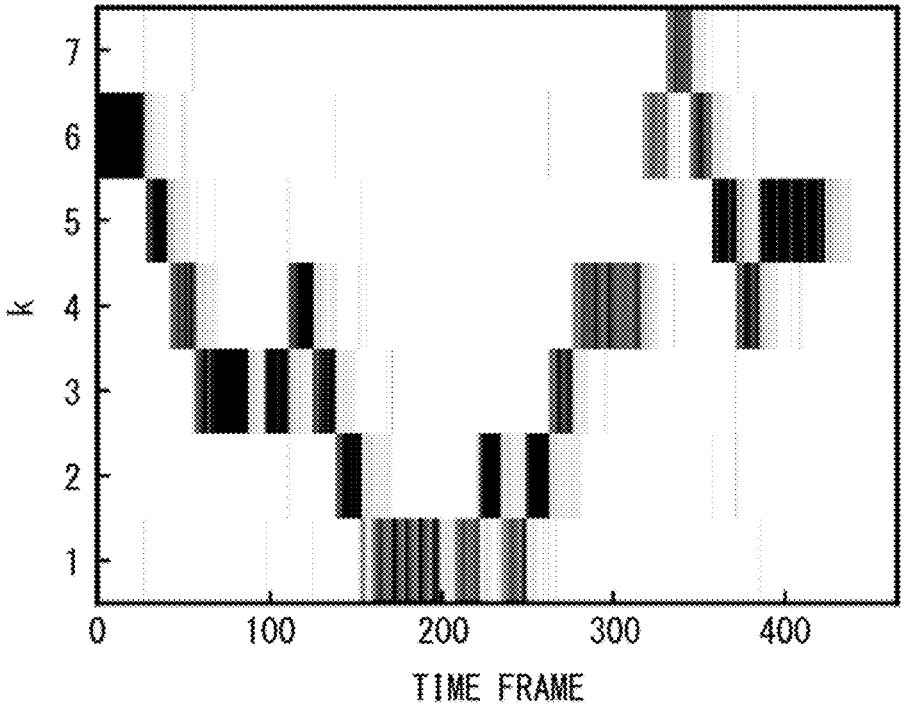
FIG. 20 is a diagram illustrating a heat map of an element product of an activation and a binary mask of correct answer data that has been learned in advance.

FIG. 20 is a diagram illustrating a heat map of an element product of the activation and the binary mask of correct answer data that had been learned in advance. In FIG. 20, the horizontal axis represents a time frame, and the vertical axis represents the number k of bases. It was assumed that the correlation coefficient of the base took a value closed to "1" when a musical instrument sound corresponding to the given onset was separated and the correction coefficient took a value close to "0" when any other base was separated.

Figure 21:
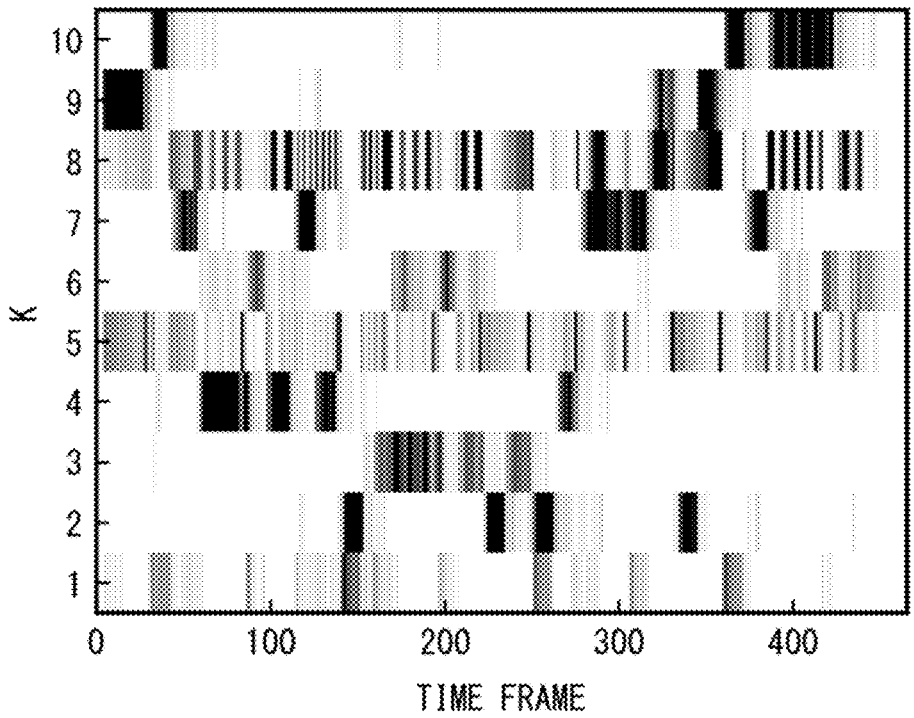
FIG. 21 is a diagram illustrating a heat map of an element product of an activation and a binary mask in a case in which there is no onset.

FIG. 21 is a diagram illustrating a heat map of an element product of the activation and the binary mask when there was no onset. In FIG. 20, the horizontal axis represents a time frame, and the vertical axis represents the number k of bases. In addition, when no onset was given, sorting of the base was not performed.

When FIG. 20 (answer data) is compared with FIG. 21, the sound source was not appropriately separated when there was no onset.

Figure 22:
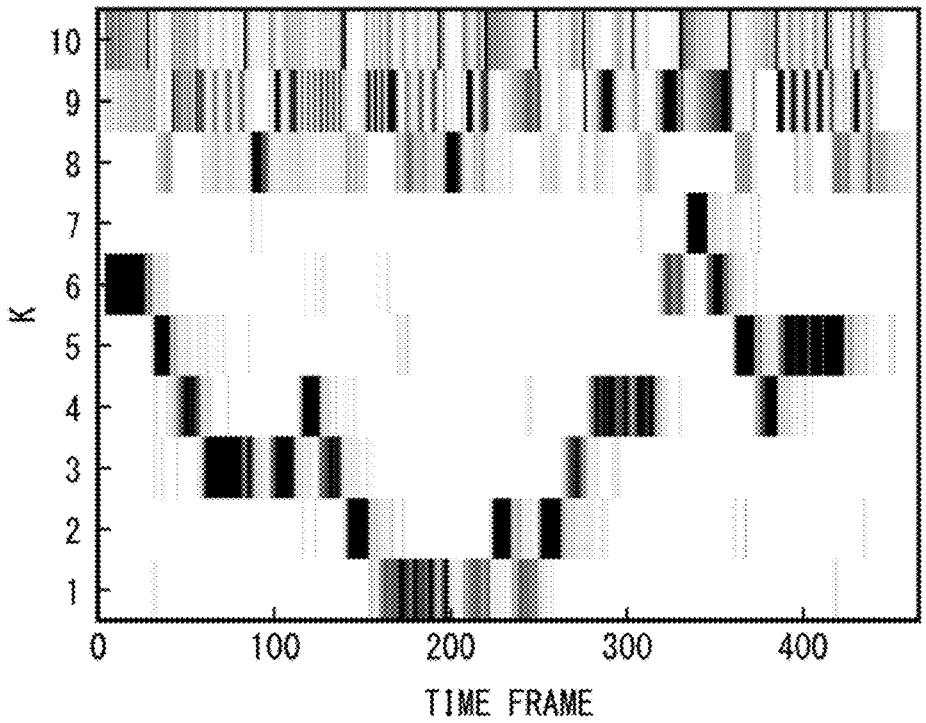
FIG. 22 is a diagram illustrating a heat map of an element product of an activation and a binary mask in a case in which there is an onset.

FIG. 22 is a diagram illustrating a heat map of an element product of the activation and the binary mask when there was an onset. In FIG. 22, the horizontal axis represents a time frame, and the vertical axis represents the number k of bases.

When FIG. 20 (answer data) is compared with FIG. 22, it could be checked that the target base was separated when an onset was given.

Figure 23:
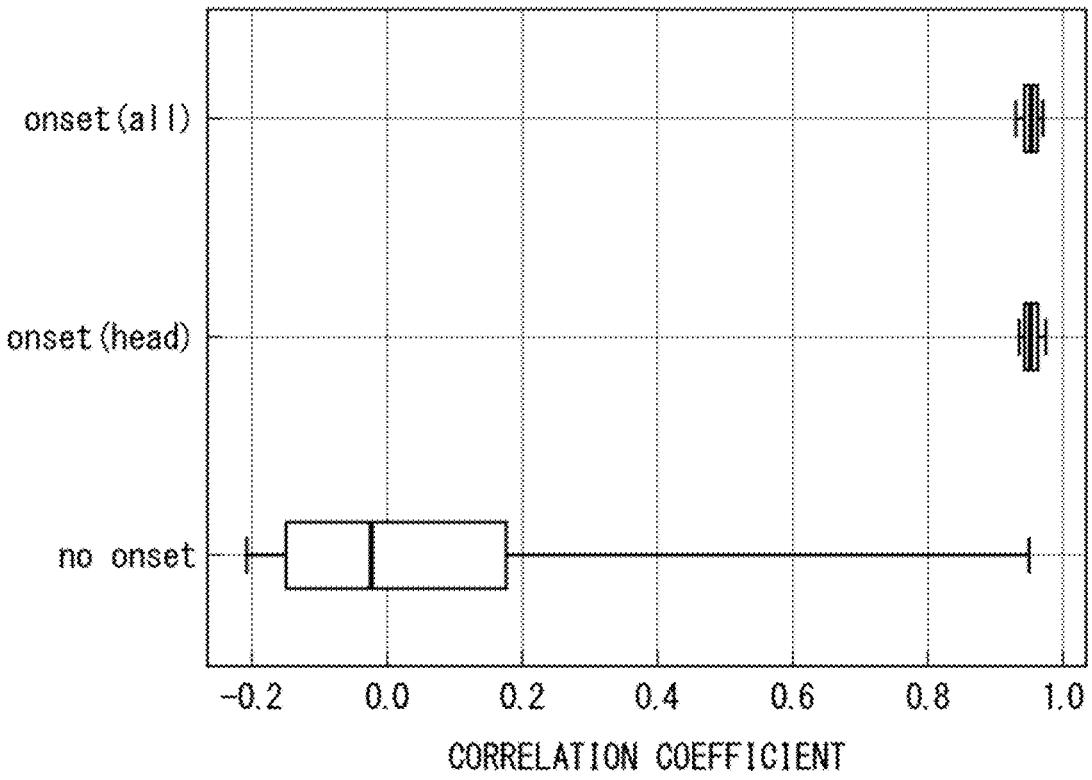
FIG. 23 is a box plot of a correlation coefficient of each of a case in which there is no onset, a case in which there is an onset only in a start sound, and a case in which there are onsets in all the sounds.
Figure 24:
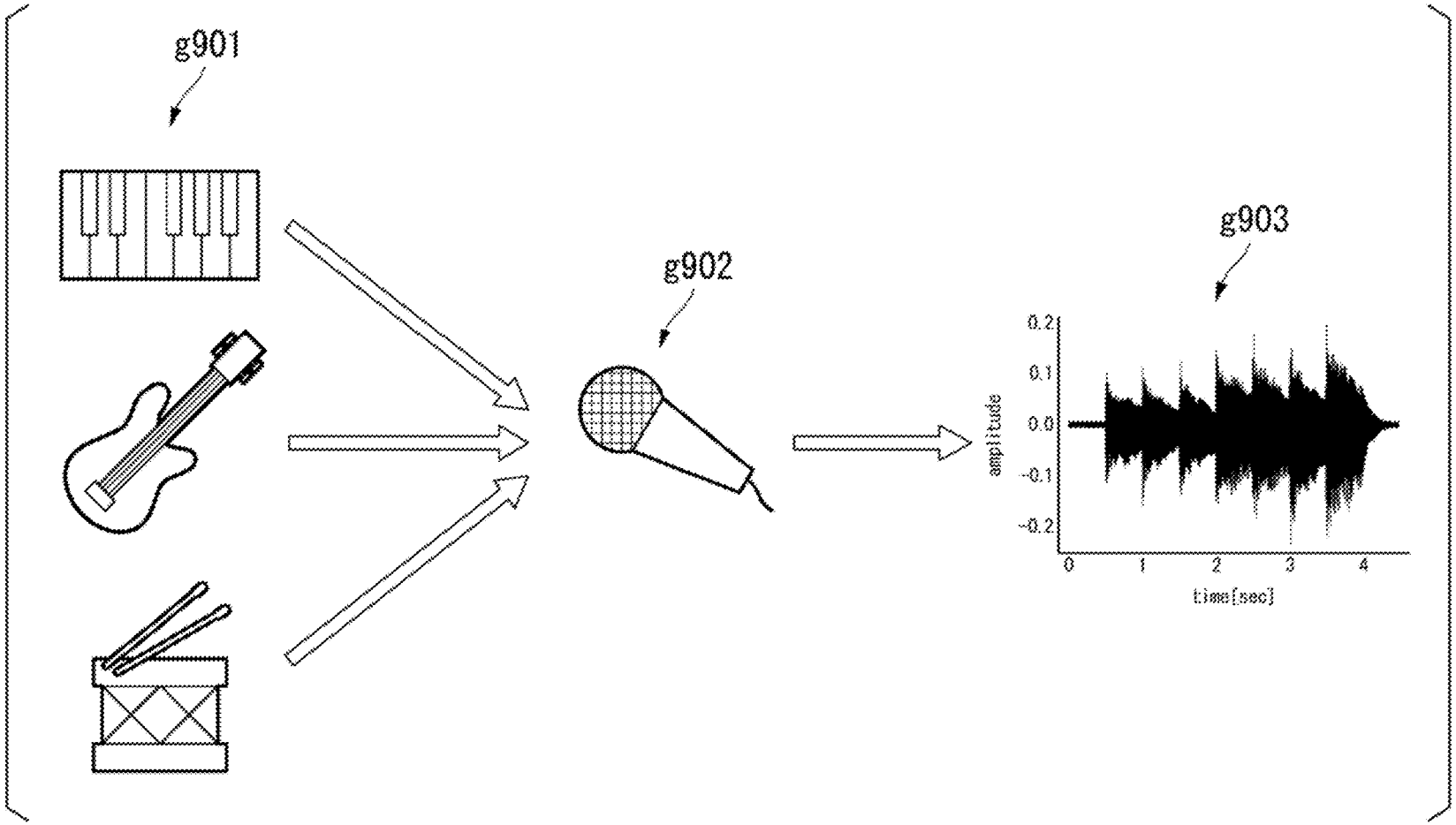
FIG. 24 is a diagram illustrating an example of a sound signal recorded by one microphone.

FIG. 23 is a box plot of a correlation coefficient of each of a case in which there was no onset (no onset), a case in which there was an onset only in the start sound (head), and a case in which there were onsets in all the sounds (all).

In FIG. 23, the horizontal axis represents a correlation coefficient (correlation), and the vertical axis represents that there is no onset (no onset), there was an onset only in the start sound (head), and there were onsets in all the sounds (all). In FIG. 23, beards represent the minimum value and the maximum value, and a left end and a right end of the box represents a first quartile point and a third quartile point, and a line at the center of the box represents a center value.

When no onset was given, the center value had values close to "0", and accordingly, it was found that the base and a sound height were not appropriately in correspondence with each other.

When an onset was given, the correlation coefficient of the base had a value close to "1", and accordingly, a musical instrument sound corresponding to the given onset was separated.

As described above, in this embodiment, a binary mask based on a Markov chain can be introduced to NMF, whereby an onset can be given. Then, in this embodiment, a timing (start) of the onset input by a user is acquired.

In other words, in this embodiment, a user marks a sound generation timing of a target sound source, a binary mask corresponding to the presence of the target sound source is estimated on the basis of the Markov chain model, and this mask is introduced to a frame set in which non-negative matrix factorization NMF is represented as a probability model.

In this way, in this embodiment, a target musical instrument sound can be separated using the start timing input by the user. As a result, according to this embodiment, a sound source can be separated from a monaural sound source in which sounds of a plurality of sound sources are mixed with a higher accuracy than that of a conventional technology using no onset.

In addition, according to this embodiment, by only user's performing an operation of attaching a mark to a position at which the target sound source appears by operating the operation unit 2 for a part of a signal desired to be separated as preprocessing, the sound source to which the mark has been attached can be separated and extracted. Furthermore, according to this embodiment, a teacher sound source is not necessary, and there is an advance of having a small load.

In addition, in the example described above, although musical instruments were described as examples of a sound source included in a sound signal, the sound source is not limited thereto.

In addition, all or some of the processes performed by the sound source separating device 1 may be performed by recording a program used for realizing all or some of the functions of the sound source separating device 1 according to the present invention on a computer readable recording medium and causing a computer system to read and execute the program recorded on this recording medium. A "computer system" described here may include an OS and hardware such as peripheral devices. In addition, the "computer system" also may include a WWW system having a home page providing environment (or a display environment). A "computer-readable recording medium" represents a storage device including a portable medium such as a flexible disk, a magneto-optical disc, a ROM, or a CD-ROM, a hard disk built in a computer system, and the like. Furthermore, a "computer-readable recording medium" may include a server in a case in which a program may be transmitted through a network such as the Internet or a communication line such as a telephone line or a device such as a volatile memory (RAM) disposed inside a computer system that serves as a client that stores a program for a predetermined time.

In addition, the program described above may be transmitted from a computer system storing this program in a storage device or the like to another computer system through a transmission medium or a transmission wave in a transmission medium. Here, the "transmission medium" transmitting a program represents a medium having an information transmitting function such as a network (communication network) including the Internet and the like or a communication line (communication wire) including a telephone line and the like. The program described above may be used for realizing part of the functions described above. In addition, the program described above may be a program realizing the functions described above by being combined with a program recorded in the computer system in advance, a so-called a differential file (differential program).

While a preferred embodiment of the invention has been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A sound source separating device separating a specific sound source from a sound signal by decomposing a spectrogram generated from the sound signal into a base spectrum and an activation through non-negative matrix factorization, the sound source separating device comprising:

a signal acquiring unit configured to acquire the sound signal including mixed sounds from a plurality of sound sources;

a start information acquiring unit configured to acquire start information representing a start timing of at least one sound source among the plurality of sound sources; and a sound source separating unit configured to separate a specific sound source from the sound signal by setting a binary mask S controlling presence of the sound source using a variable of "0" and "1" and using a Markov chain for the activation H on the basis of the start information and decomposing the spectrogram X generated from the sound signal into the base spectrum W and the activation H through non-negative matrix factorization using the set binary mask S.

2. The sound source separating device according to claim 1, wherein the sound source separating unit indirectly uses an onset I based on the start information to assist estimation of the binary mask S in Gibbs sampling in which the base spectrum W, the activation H, and the binary mask S are estimated without including the start information in a probability model of the non-negative matrix factorization.

3. The sound source separating device according to claim 1, wherein the sound source separating unit estimates the base spectrum W, the activation H, and the binary mask S by estimating an expected value of each of the base spectrum W, the activation H, and the binary mask S using Gibbs sampling.

4. The sound source separating device according to claim 1, wherein the sound source separating unit initializes the base spectrum W, the activation H, and the binary mask S and thereafter estimates an expected value for each of the base spectrum W, the activation H, and the binary mask S using the following equations using Gibbs sampling $$W^{(i+1)} \sim p(W|Z^{(i+1)}, H^{(i)}, S^{(i)}, X)$$

$$H^{(i+1)} \sim p(H|Z^{(i+1)}, W^{(i+1)}, S^{(i)}, X)$$

$$S^{(i+1)} \sim p(S|Z^{(i+1)}, W^{(i+1)}, H^{(i+1)}, X).$$

5. A sound source separating method in a sound source separating device separating a specific sound source from a sound signal by decomposing a spectrogram generated from the sound signal into a base spectrum and an activation through non-negative matrix factorization, the sound source separating method comprising:

acquiring the sound signal including mixed sounds from a plurality of sound sources by using a signal acquiring unit;

acquiring start information representing a start timing of at least one sound source among the plurality of sound sources by using a start information acquiring unit; and separating a specific sound source from the sound signal by setting a binary mask S controlling presence of the sound source using a variable of "0" and "1" and using a Markov chain for the activation H on the basis of the start information and decomposing the spectrogram X generated from the sound signal into the base spectrum W and the activation H through non-negative matrix factorization using the set binary mask S by using a sound source separating unit.

6. A computer-readable non-transitory storage medium having a program stored thereon, the program causing a computer in a sound source separating device separating a specific sound source from a sound signal by decomposing a spectrogram generated from the sound signal into a base spectrum and an activation through non-negative matrix factorization to execute:

acquiring the sound signal including mixed sounds from a plurality of sound sources;

acquiring start information representing a start timing of at least one sound source among the plurality of sound sources; and separating a specific sound source from the sound signal by setting a binary mask S controlling presence of the sound source using a variable of "0" and "1" and using a Markov chain for the activation H on the basis of the start information and decomposing the spectrogram X generated from the sound signal into the base spectrum W and the activation H through non-negative matrix factorization using the set binary mask S.

* * * * *